US007566520B2

(12) United States Patent
Miura et al.

(10) Patent No.: US 7,566,520 B2
(45) Date of Patent: Jul. 28, 2009

(54) LIQUID DEVELOPER

(75) Inventors: Satoru Miura, Matsumoto (JP); Takashi Teshima, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 276 days.

(21) Appl. No.: 11/461,736

(22) Filed: Aug. 1, 2006

(65) Prior Publication Data

US 2007/0184378 A1 Aug. 9, 2007

(30) Foreign Application Priority Data

Aug. 1, 2005 (JP) ..... 2005-223427

(51) Int. Cl.
*G03G 9/12* (2006.01)

(52) U.S. Cl. ..... 430/114; 430/115

(58) Field of Classification Search ..... 430/114, 430/115

See application file for complete search history.

(56) References Cited

U.S. PATENT DOCUMENTS

2003/0134940 A1* 7/2003 Morrison et al. ..... 523/160
2006/0142425 A1* 6/2006 Akioka et al. ..... 523/223

FOREIGN PATENT DOCUMENTS

JP 2002-214849 7/2002

* cited by examiner

*Primary Examiner*—John L Goodrow
(74) *Attorney, Agent, or Firm*—Hogan & Hartson LLP

(57) ABSTRACT

A liquid developer of the type that is positively-charged is provided. The liquid developer includes an insulation liquid, and toner particles dispersed in the insulation liquid, wherein each of the toner particles includes a toner matrix particle mainly made of a polyester resin and a positively-charged polymeric dispersant adhering to the surface of the toner matrix particle. The polymeric dispersant is preferably of the type that an amino group is contained in its molecule, or of the type that an ester structure is contained in its molecule. Further, the polyester resin is preferably of the type that a $—SO_3^-$ group is contained in its molecule. The liquid developer has excellent positively-chargeable charging characteristics and fixing characteristics.

9 Claims, 7 Drawing Sheets

LIQUID DEVELOPER

CROSS-REFERENCE TO RELATED APPLICATION

This application claims priorities to Japanese Patent Applications No. 2005-223427 filed on Aug. 1, 2005 which is hereby expressly incorporated by reference herein in its entirety.

BACKGROUND OF THE INVENTION

1. Field of the Invention

The present invention relates to a liquid developer, and more specifically to a positively-charged liquid developer.

2. Description of the Prior Art

As a developer used for developing an electrostatic latent image formed on a latent image carrier, there are known a liquid developer which is obtained by dispersing toner particles composed of a toner material containing a binder resin and a coloring agent such as pigments into a carrier liquid having electric insulation properties, that is, an insulation liquid. Generally, a polyester resin is used for such a binder resin for toner particles contained in a liquid developer. Polyester resins have high transparency, and thus when such resins are used as a binder resin, there are advantages in that obtained images can provide excellent color development and excellent fixing characteristics.

In the meantime, such liquid developers include two types, one of which is a negatively-charged liquid developer and the other of which is a positively-charged liquid developer. However, when such a negatively-charged is used, there is a problem in that ozone is generated in an image forming apparatus, and generation of such ozone not only causes an environmental problem but also gives any adverse effects to peripheral components provided in the image forming apparatus.

On the other hand, in the case of a positively-charged liquid developer, images can be formed with less generation of corona products such as ozone and the like. Therefore, in recent years, researches and developments are conducted for methods for forming images using positively-charged liquid developers (one example of such a liquid developer is disclosed in JP-A No. 2002-214849).

However, generally, polyester resins are negatively-charged type resins. Therefore, it is difficult to use a polyester resin to positively-charged toner particles (liquid developer). Further, there may be an approach that toner particles formed using a binder resin made of a polyester resin are allowed to be positively-charged by adding a charge control agent to the binder resin. However, according to this approach, it is difficult to obtain a sufficient amount of positive toner charging.

SUMMARY OF THE INVENTION

Accordingly, it is an object of the present invention to provide a liquid developer which has excellent positively-charged characteristics as well as excellent fixing characteristics of toner particles.

In order to achieve the above mentioned object, the present invention is directed to a positively-charged liquid developer, which includes an insulation liquid, and toner particles dispersed in the insulation liquid, wherein each of the toner particles comprises a toner matrix particle mainly constituted of a polyester resin and a positively-charged polymeric dispersant adhering to the surface of the toner matrix particle.

According to the liquid developer of the present invention described above, it is possible to provide a liquid developer having excellent positively charging properties as well as excellent fixing characteristics.

In the liquid developer according to the present invention, it is preferred that the polymeric dispersant is of the type that an amino group is contained in its molecule.

According to this liquid developer, since the polymeric dispersant having such an amino group has a high positively-charged property, use of such a polymeric dispersant can improve a positively-charged property of the toner particles (that is, liquid developer) further.

Further, in the liquid developer according to the present invention, it is also preferred that the polymeric dispersant is of the type that an ester structure is contained in its molecule.

According to the liquid developer described above, the compatibility with the polyester resin constituting the toner matrix particles is improved. As a result, the polymeric dispersant can adhere to the surfaces of the toner matrix particles more firmly.

Furthermore, in the liquid developer according to the present invention, it is preferred that the amount of the polymeric dispersant contained in each of the toner particles is in the range of 1 to 20 parts by weight with respect to 100 parts by weight of the polyester resin.

According to the liquid developer described above, a negatively-charged property of the toner matrix particles derived from the polyester resin can be cancelled more reliably, so that it is possible to raise the positively-charged property of the toner particles further.

Moreover, in the liquid developer according to the present invention, it is also preferred that the density of the polymeric dispersant is in the range of 0.8 to 1.0 g/cm$^3$.

According to the liquid developer described above, the compatibility between the polyester resin and the polymeric dispersant becomes higher so that the dispersant can adhere to the surfaces of the toner matrix particles more firmly. In addition, dispersibility of the toner particles can be made higher.

Moreover, in the liquid developer according to the present invention, it is also preferred that the polyester resin is of the type that a $—SO_3^-$ group is contained in its molecule.

According to the liquid developer described above it is possible to retain a polymeric dispersant (which will be described later) onto the surface of each toner matrix particle more reliably.

In the liquid developer described above, it is preferred that the number of moles of the $—SO_3^-$ group contained in the polyester resin is in the range of 0.001 to 0.050 mol with respect to 100 g of the polyester resin.

This makes it possible to retain a polymeric dispersant described later to the surfaces of the toner matrix particles more reliably.

Further, in the liquid developer according to the present invention, it is also preferred that the acid value of the polyester resin is in the range of 5 to 20 KOHmg/g.

This also makes it possible to retain a polymeric dispersant described later to the surfaces of the toner matrix particles more reliably.

Further, in the liquid developer according to the present invention, it is also preferred that the insulation liquid contains as its main component a plant oil.

Use of such a plant oil as the insulation liquid makes it possible to improve dispersibility of the toner particles as well as to prevent the polymeric dispersant that has adhered to the surfaces of the toner matrix particles from being peeled off undesirably.

These and other objects, structures and effects of the present invention will be more apparent when the following detailed description of the preferred embodiments and the examples will be considered taken in conjunction with the appended drawings.

DETAILED DESCRIPTION OF THE PREFERRED EMBODIMENTS

Figure 1:
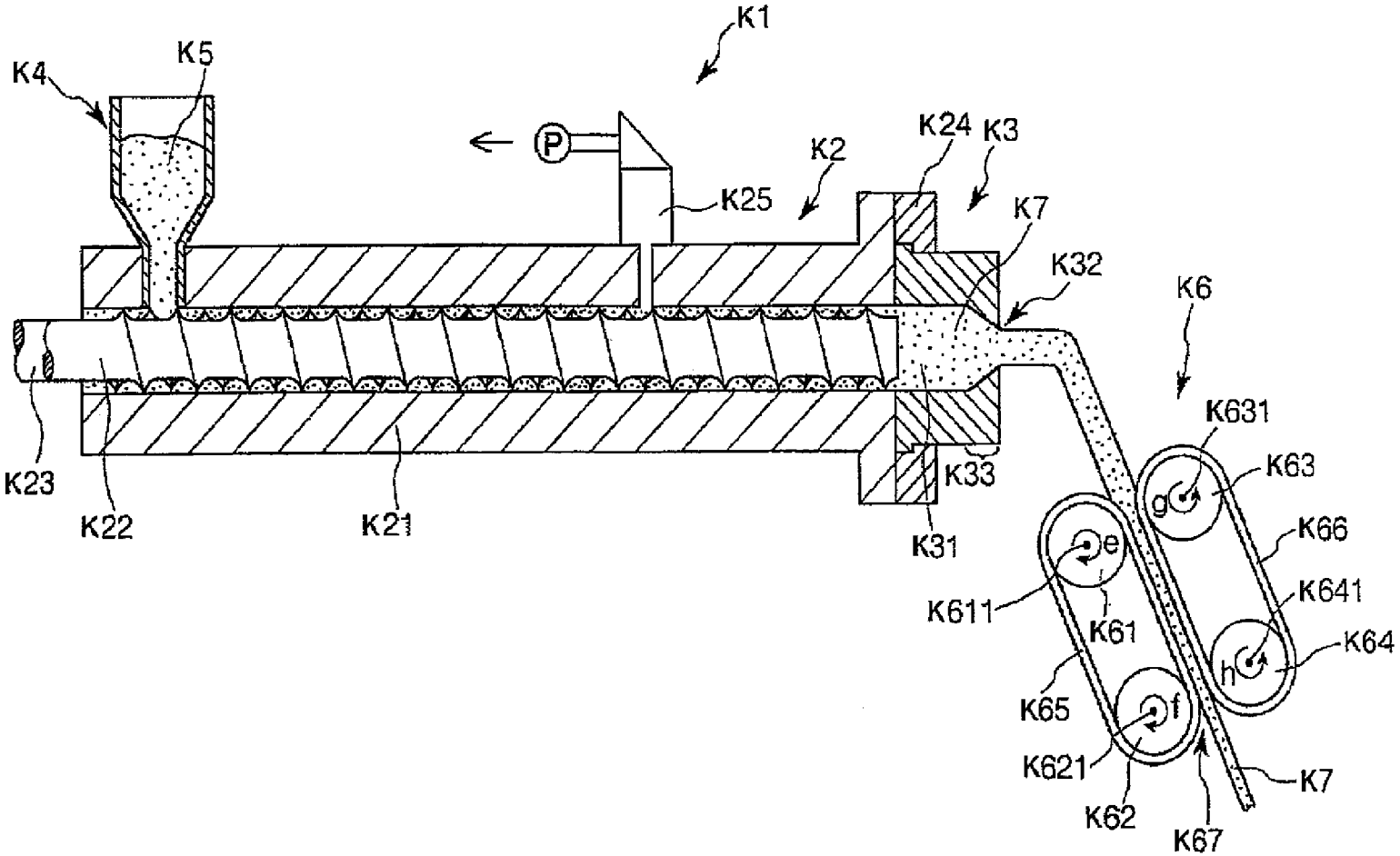
FIG. 1 is a vertical cross-sectional view which schematically shows one example of the structure of a kneading machine and a cooling machine for producing a kneaded material used for preparing a water-based emulsion from which toner particles used in a liquid developer according to the present invention are to be formed.

Hereinbelow, with reference to the accompanying drawings, preferred embodiments of a liquid developer according to the present invention will be described in details.

Liquid Developer

A liquid developer of the present invention includes an insulation liquid and toner particles dispersed in the insulation liquid. Further, in each of the toner particles, a positively-charged polymeric dispersant adheres to the surface of the toner matrix particle.

<<Toner Particles>>

First, a description will be made with regard to the toner particles used in the liquid developer according to the present invention.

Each of the toner particles of the present invention is constituted from a toner matrix particle and a positively-charged polymeric dispersant adhering to the surface of the toner matrix particle.

<Toner Matrix Particle>

(Constituent Material of Toner Matrix Particle)

A toner matrix particle contains at least a binder resin (binder material) and a coloring agent.

1. Binder Resin (Binder Material)

A toner matrix particle is constituted from a material which contains as its main component a binder resin.

In the present invention, The binder resin is mainly composed of a polyester resin. Such a polyester resin has high transparency, and thus when such a polyester resin is used as a binder resin, there are advantages in that obtained images can provide excellent color development and excellent fixing characteristics can be obtained. In this regard, it is to be noted that an amount of the polyester resin contained in the binder resin is preferably 50 wt % or more, and more preferably 80 wt % or more.

Further, it is preferred that the polyester resin is of the type that its molecule has an anionic group. This makes it possible to retain a polymeric dispersant (which will be described later) onto the surface of each toner matrix particle reliably.

Furthermore, a polyester resin having an anionic group has excellent dispersibility in a water-based liquid. Therefore, in the case where a liquid developer is produced, for example, using a method described later, it is possible to prepare a water-based dispersing liquid (that is, a water-based emulsion and a water-based suspension) described later appropriately without using a surfactant or by using an extremely small amount of surfactant.

Examples of such an anionic group include —$COO^-$ group, —$SO_3^-$ group, —CO group, —OH group, —$OSO_3^-$ group, —COO— group, —$SO_3$— group, —$OSO_3$— group, —$PO_3H_2$ group, —$PO_4^-$ group, and quaternary ammonium, and salts thereof.

Further, among the groups mentioned above, —$SO_3^-$ group is particularly preferred. This makes it possible to retain a polymeric dispersant (which will be described later) onto the surface of each toner matrix particle more reliably. Further, a polyester resin having such a group has particularly superior dispersion properties in the water-based liquid and it can be manufactured relatively easily and he available at a relatively low cost. As a result, it is possible to further reduce production cost of the liquid developer.

Furthermore it is preferred that the group mentioned above exists at a side chain of a polymer constituting the polyester resin. This makes it possible to retain a polymeric dispersant (which will be described later) onto the surface of each toner matrix particle more reliably. In addition, this also makes it possible to make hydrophilic property against the water-based liquid more excellent, and thereby to make dispersibility of a dispersoid constituted from a self-dispersible type resin in a water-based liquid (that is, a water-based emulsion and a water-based suspension) especially excellent. Furthermore, it is also possible to manufacture a liquid developer by a method which is harmless to environment since such a liquid developer does not use any polar organic solvents.

The polyester resin having an anionic group as described above can be manufactured by bonding a material having the functional group described above (that is, the anionic group) to a polyester resin or its monomer, dimer, oligomer, and the like.

For example, a polyester resin having —$SO_3^-$ group can be produced by graft copolymerization or block-copolymerization of a polyester resin with unsaturated surfonic acids, by random copolymerization of unsaturated monomers constituting an addition polymerization type polyester with monomers containing an unsaturated sulfonic acid, or by a polycondensation of unsaturated monomers constituting a polycondensation type thermoplastic resin with monomers containing an unsaturated sulfonic acid.

Examples of such sulfonic acids include styrene sulfonic acids, sulfoalkkyl(meth)acrylate, metal salts thereof, and ammonium salts, and the like. Further, examples of a monomer containing sulfonic acids include sulufo-isophthalic acids, sulufo-terephthalic acids, sulfo-phthalic acids sulfo-siccomoc acids, sulfo-benzoic acids, sulfo-salicylic acids, and metal salts thereof, and ammonium salts, and the like.

Such a polyester resin having an anionic group as described above can also be manufactured by polymerizing precursors (such as monomer, dimer, oligomer, and the like) having the functional groups described above.

The number of anionic groups contained in the polyester resin is preferably in the range of 0.001 to 0.050 mol with respect to 100 g of polyester resin, and more preferably in the range of 0.005 to 0.030 mol. This makes it possible to retain a polymeric dispersant described later to the surfaces of the toner matrix particles more reliably.

Further, the acid value of the polyester resin described above is preferably in the range of 5 to 10 KOHmg/g, and more preferably in the range of 5 to 20 KOHmg/g. This also makes it possible to retain a polymeric dispersant (which will be described later) onto the surface of each toner matrix particle more reliably.

Furthermore, the softening point of the polyester resin is not limited to any specific value, but it is preferably in the range of 50 to 130° C., and more preferably in the range of 50 to 120° C., and still more preferably in the range of 60 to 115° C. In this specification, the term "softening point" means a temperature at which softening begins under the conditions that a temperature raising speed is 5° C./mim and a diameter of a die hole is 1.0 mm in a high-floored flow tester (a product of Shimadzu Corporation).

In connection with the binder resin used for the toner matrix particles, it is to be noted that the binder resin may contain other resin materials in addition to the polyester resin as described above.

2. Coloring Agent

The constituent material of the toner matrix particles also includes a coloring agent. As for a coloring agent, pigments, dyes or the like can be used. Examples of such pigments and dyes include Carbon Black, Spirit Black, Lamp Black (C.I. No. 77266), Magnetite, Titanium Black, Chrome Yellow, Cadmium Yellow, Mineral Fast Yellow, Navel Yellow, Naphthol Yellow S, Hansa Yellow G, Permanent Yellow NCG, Benzidine Yellow, Quinoline Yellow, Tartrazine Lake, Chrome Orange, Molybdenum Orange, Permanent Orange GTR, Pyrazolone Orange, Benzidine Orange G, Cadmium Red, Permanent Red 4R, Watching Red Calcium Salt, Eosine Lake, Brilliant Carmine 3B, Manganese Violet, Fast Violet B, Methyl Violet Lake, Prussian Blue, Cobalt Blue, Alkali Blue Lake, Victoria Blue Lake, Fast Sky Blue, Indanthrene Blue BC, Ultramarine Blue, Aniline Blue, Phthalocyanine Blue, Chalco Oil Blue, Chrome Green, Chromium Oxide, Pigment Green B, Malachite Green Lake, Phthalocyanine Green, Final Yellow Green G, Rhodamine 6G, Quinacridone, Rose Bengal (C.I. No. 45432), C.I. Direct Red 1, C.I. Direct Red 4, C.I. Acid Red 1, C.I. Basic Red 1, C.I. Mordant Red 30, C.I. Pigment Red 48:1, C.I. Pigment Red 57:1, C.I. Pigment Red 122, C.I. Pigment Red 184, C.I. Direct Blue 1, C.I. Direct Blue 2, C.I. Acid Blue 9, C.I. Acid Blue 15, C.I. Basic Blue 3, C.I. Basic Blue 5, C.I. Mordant Blue 7, C.I. Pigment Blue 15:1, C.I. Pigment Blue 15:3, C.I. Pigment Blue 5:1, C.I. Direct Green 6, C.I. Basic Green 4, C.I. Basic Green 6, C.I. Pigment Yellow 17, C.I. Pigment Yellow 93, C.I. Pigment Yellow 97, C.I. Pigment Yellow 12, C.I. Pigment Yellow 180, C.I. Pigment Yellow 162, and Nigrosine Dye (C.I. No. 50415B); metal oxides such as metal complex dyes, silica, aluminum oxide, magnetite, maghemite, various kinds of ferrites, cupric oxide, nickel oxide, zinc oxide, zirconium oxide, titanium oxide, magnesium oxide, and the like; and magnetic materials including magnetic metals such as Fe, Co, and Ni; and the like. These pigments and dyes can be used singly or in combination of two or more of them.

Further, as a coloring agent, a pigment-derivative which is a combination of any one or more of the pigments as described and a polymeric material can be used. Since such a pigment-derivative has high compatibility with the polyester resin as described above, the pigment-derivative can be uniformly or homogeneously dispersed in the polyester resin. As a result, an obtained liquid developer exhibits excellent color development.

In this case, it is preferred to use a pigment-derivative of a positively-charged type. By using such a positively-charged type pigment-derivative, it is possible to moderate a negatively-charged property of a polyester resin. As a result, an effect obtained by allowing a polymeric dispersant as described later to adhere to the surfaces of the toner matrix particles can be made more conspicuous.

As examples of such a positively-charged type pigment-derivative, "SOLSPERSE 5000" and "SOLSPERSE 22000" (product names of Lubrizol Japan Ltd.) and the like can be mentioned.

3. Other Components

The constituent material of the toner matrix particles may contain additional components other than the above components. Examples of such other components include a wax, a charge control agent, a magnetic powder, and the like.

Examples of such a wax include hydrocarbon wax such as ozokerite, ceresin, paraffin wax, micro wax, microcrystalline wax, petrolatum, Fischer-Tropsch wax, or the like; ester wax such as carnauba wax, rice wax, methyl laurate, methyl myristatc, methyl palmitate, methyl stearate, butyl stearate, candelilla wax, cotton wax, Japan wax, beeswax lanolin, montan wax, fatty ester, or the like; olefin wax such as polyethylene wax, polypropylene wax, oxidized polyethylene wax, oxidized polypropylene wax, or the like; amide wax such as 12-hydroxystearic acid amide, stearic acid amide, phthalic anhydride imide, or the like; ketone wax such as laurone, stearone, or the like; ether wax; and the like. These waxes can be used singly or in combination of two or more.

Further, examples of the charge control agent include a metallic salt of benzoic acid, a metallic salt of salicylic acid, a metallic salt of alkylsalicylic acid, a metallic salt of catechol, a metal-containing bisazo dye, a nigrosine dye, tetraphenyl borate derivatives, a quaternary ammonium salt, an alkylpyridinium salt, chlorinated polyester, nitrohumic acid, and the like.

Furthermore, examples of the magnetic powder include a powder made of a magnetic material containing a metal oxide such as magnetite, maghemite, various kinds of ferrites, cupric oxide, nickel oxide, zinc oxide, zirconium oxide, titanium oxide, magnesium oxide, or the like, and/or magnetic metal such as Fe, Co or Ni.

In addition to the above, the constituent material of the toner matrix particles may further contain zinc stearate, zinc oxide, cerium oxide, silica, titanium oxide, iron oxide, aliphatic acid, or aliphatic metal salt, or the like in addition to the materials described above.

(Shape of Toner Matrix Particles)

An average particle size (diameter) of the toner matrix particles constituted from the above described materials is preferably in the range of 0.1 to 5 μm, more preferably in the range of 0.1 to 4 μm, and even more preferably in the range of 0.5 to 3 μm. If the average particle size of the toner particles is within the above range, variations in properties of the toner matrix particles can be made sufficiently small. Consequently, it is possible to make resolution of a toner image formed from the liquid developer (liquid toner) sufficiently high so that the liquid developer can have high reliability as a whole.

Further, it is preferred that a standard deviation of particle size among the toner matrix particles which constitute the liquid developer is 1.0 μm or less, more preferably in the range of 0.1 to 1.0 μm, and even more preferably in the range of 0.1 to 0.8 μm. When the standard deviation of particle size lies within the above range, variations in properties of the toner particles can be made especially small, thereby further improving the reliability of the liquid developer as a whole.

Furthermore, it is also preferred that an average roundness R of the toner matrix particles which constitute the liquid developer represented by the following formula (I) is 0.85 or higher, more preferably in the range of 0.90 to 0.99, and even more preferably 0.92 to 0.99.

$$R=L_0/L_1 \quad (I)$$

wherein $L_1$ (μm) represents the circumference of projected image of a toner particle that is a subject of measurement, and $L_0$ (μm) represents the circumference of a perfect circle (a geometrically perfect circle) having the same area as that of the projected image of the toner matrix particle that is a subject of measurement.

When the average roundness R of the toner particles is within the above range, the transfer efficiency and the mechanical strength of the toner matrix particles can be made excellent while the particle size of the toner matrix particles can be made sufficiently small.

In this case, it is preferred that a standard deviation of the average roundness among the toner matrix particles is 0.15 or less, more preferably in the range of 0.001 to 0.10, and even more preferably 0.001 to 0.05. When the standard deviation of the average roundness among the toner matrix particles lies within the above range, variations in electrification properties (chargeable characteristics), fixing properties, etc are especially small, thereby further improving the reliability of the liquid developer as a whole.

<Polymeric Dispersant>

The toner particles contained in the liquid developer of the present invention are constituted from the toner matrix particles described above and a polymeric dispersant adhering to the surfaces of the toner matrix particles. The polymeric dispersant is of the type that has a positively-charged property (positive charging property).

As described above, a polyester resin is a negatively-charged type resin. Therefore, it is difficult to use a polyester resin to positively-charged toner particles (liquid developer). Further, there may be an approach that toner particles formed using a binder resin made of a polyester resin are allowed to be positively-charged by adding a charge control agent to the binder resin. However, according to this approach, it is difficult to obtain a sufficient amount of positive toner charging.

In contrast, according to the present invention, the toner particles contained in the liquid developer are constituted from the toner matrix particles described above and a positively-discharged type polymeric dispersant adhering to the surfaces of the toner matrix particles. Use of such toner particles can obtain such effects as described below.

Specifically, since the toner matrix particles are formed of a polyester resin, they have a negatively-charged property in their original nature. However, in the present invention, a positively-charged type dispersant is adhering to the surfaces of the toner matrix particles to cancel its negatively-charged property so that the toner particles are reliably positively-charged. Further, since the polymeric dispersant is a polymer, it has high compatibility with the polyester resin. In addition, since the polymeric dispersant has a positively-charged property, it exhibits high adhesion with the toner matrix particles which have a negatively-charged property. With these results, it is possible to prevent undesirable peeling-off of the polymeric dispersant from each toner matrix particle, and therefore the toner particles (that is, the liquid developer) can have a stable positively-charged property as well as excellent durability. Further, since the polymeric dispersant is adhering to the surfaces of the toner matrix particles, it is possible to prevent aggregation of the toner particles from occurring, and thus dispersibility of the toner particles is also improved. Furthermore, since the toner matrix particles are mainly constituted from a polyester resin, an obtained liquid developer can exhibit excellent color development as well as excellent fixing characteristics.

In particular, in the case where the polyester resin has an anionic group (in particular, —$SO_3^-$ group), the dispersant can adhere to the surfaces of the toner matrix particles firmly, so that the liquid developer can exhibit a positively-charged property stably.

Further, in the case where a charge control agent is added in the liquid developer, the charge control agent can exists in the close vicinity of the surface of each toner matrix particle due to the presence of the dispersant, and thus dispersibility is further improved.

The density of such a polymeric dispersant is preferably in the range of 0.8 to 1.0 g/cm$^3$, and more preferably in the range of 0.8 to 0.85 g/cm$^3$. If the weight average molecular weight of the polymeric dispersant lies within this range, the compatibility between the polyester resin and the polymeric dispersant becomes higher so that the dispersant can adhere to the surfaces of the toner matrix particles more firmly. In addition, dispersibility of the toner particles can be made higher.

Further, the polymeric dispersal is not particularly limited to any specific one if they have a positively-charged property. However, it is preferred that the polymeric dispersant is of the type that has an amino group in its molecule. In this case, since the polymeric dispersant having such an amino group has a high positively-charged property, use of such a polymeric dispersant can improve a positively-charged property of the toner particles (that is, liquid developer) further.

Furthermore, it is preferred that the polymeric dispersant has an ester structure in its molecule. If the polymeric dispersant has such an ester structure, the compatibility with the polyester resin constituting the toner matrix particles is improved. As a result, the polymeric dispersant can adhere to the surfaces of the toner matrix particles more firmly.

Examples of such a polymeric dispersant include a reaction product of a polyamine compound and a self-condensation type hydroxy aliphatic compound (examples of commercially available products include: "SOLSPERSE 11200", "SOLSPERSE 13940", "SOLSPFRSE 17000", and "SOLSPERSE 18000" which are product names of Lubrizol Japan Ltd.), polyvinyl alcohol, carboxymethyl cellulose, polyethylene glycol, polycarboxylic acid and salts thereof, metallic salts of polyacrylic acid (e.g. sodium salts or the like), metallic salts of polymethacrylic acid (e.g. sodium salts or the like), metallic salts of polymethacrylic acid (e.g. sodium salts or the like), metallic salts of polymaleic acid (e.g. sodium salts or the like), metallic salts of acrylic acid—maleic acid copolymer (e.g. sodium salts), metallic salts of polystyrene sulfonic acid (e.g. sodium salts or the like), and ammonium salts, and the like.

Among the above-mentioned polymeric dispersants, in the case where a reaction product of a polyamine compound and a self-condensation type hydroxy aliphatic compound is used, it is possible for the polymeric dispersant to adhere onto the surfaces of the toner matrix particles more firmly. Further, it is also possible to improve the positively-charged property of the toner particles further.

Examples of such a reaction product of a polyamine compound and a self-condensation type hydroxy aliphatic compound include a reaction product of a polyallylamine compound and a self-condensation type 1,2-hydroxystearic acid compound, a reaction product of a polyethyleneamine compound and a self-condensation type 1,2-hydroxystearic acid, and a reaction product of a dialkylainino alkylamine compound and a self -condensation type 1,2-hydroxystearic acid compound, and the like.

An amount of such a polymeric dispersant contained in the liquid developer is preferably in the range of 1 to 20 parts by weight with respect to 100 parts by weight of the polyester resin, and more preferably in the range of 3 to 10 parts by weight with respect to 100 parts by weight of the polyester resin. If the amount of the polymeric dispersant lies within the above range, a negatively-charged property of the toner matrix particles derived from the polyester resin can be cancelled more reliably, so that it is possible to raise the positively-charged property of the toner particles further.

<Insulation Liquid>

Hereinbelow, a description will be made with regard to the insulation liquid.

In the present invention, various insulation liquids can be used if they have sufficiently high insulation properties. In more details, the electric resistance of such insulation liquids as described above at room temperature (20° C.) is preferably equal to or higher than $1\times10^{9}$ Ωcm, more preferably equal to or higher than $1\times10^{11}$ Ωcm, and even more preferably equal to or higher than $1\times10^{13}$ Ωcm.

Further, the dielectric constant of the insulation liquids is preferably equal to or lower than 3.5.

Examples of the insulation liquids that satisfy these conditions include octane, isooctane, decane, isodecane, decaline, nonane, dodecane, isodecane, cyclohexane, cyclooctane, cyclodecane, benzene, toluene, xylene, mesitylene, various silicone oils, linseed oils, plant oils such as soybean oil, ISOPAR E, ISOPAR G, ISOPAR H, ISOPAR L ("ISOPAR" is a product name of Exxon Mobil), SHELLSOL 70, SHELLSOL 71 ("SHELLSOL" is a product name of Shell Oil), Amsco OMS, Amsco 460 solvent ("Amsco" is a product name of Spirit Co., Ltd.), liquid paraffin (Wako Pure Chemical Industies, Ltd.), and the like.

Among the above-mentioned insulation liquids, plant oils are preferably used, since plant oils are superior in a balance between compatibility with the polyester resin and compatibility with the polymeric dispersant. Therefore, use of such plant oils as the insulation liquid makes it possible to improve dispersibility of the toner particles as well as to prevent the polymeric dispersant that has adhered to the surfaces of the toner matrix particles from being peeled off undesirably.

Production Method of Liquid Developer

Hereinbelow, one example of the production method of the liquid developer of the present invention will be described with reference to the accompanying drawings.

Figure 2:
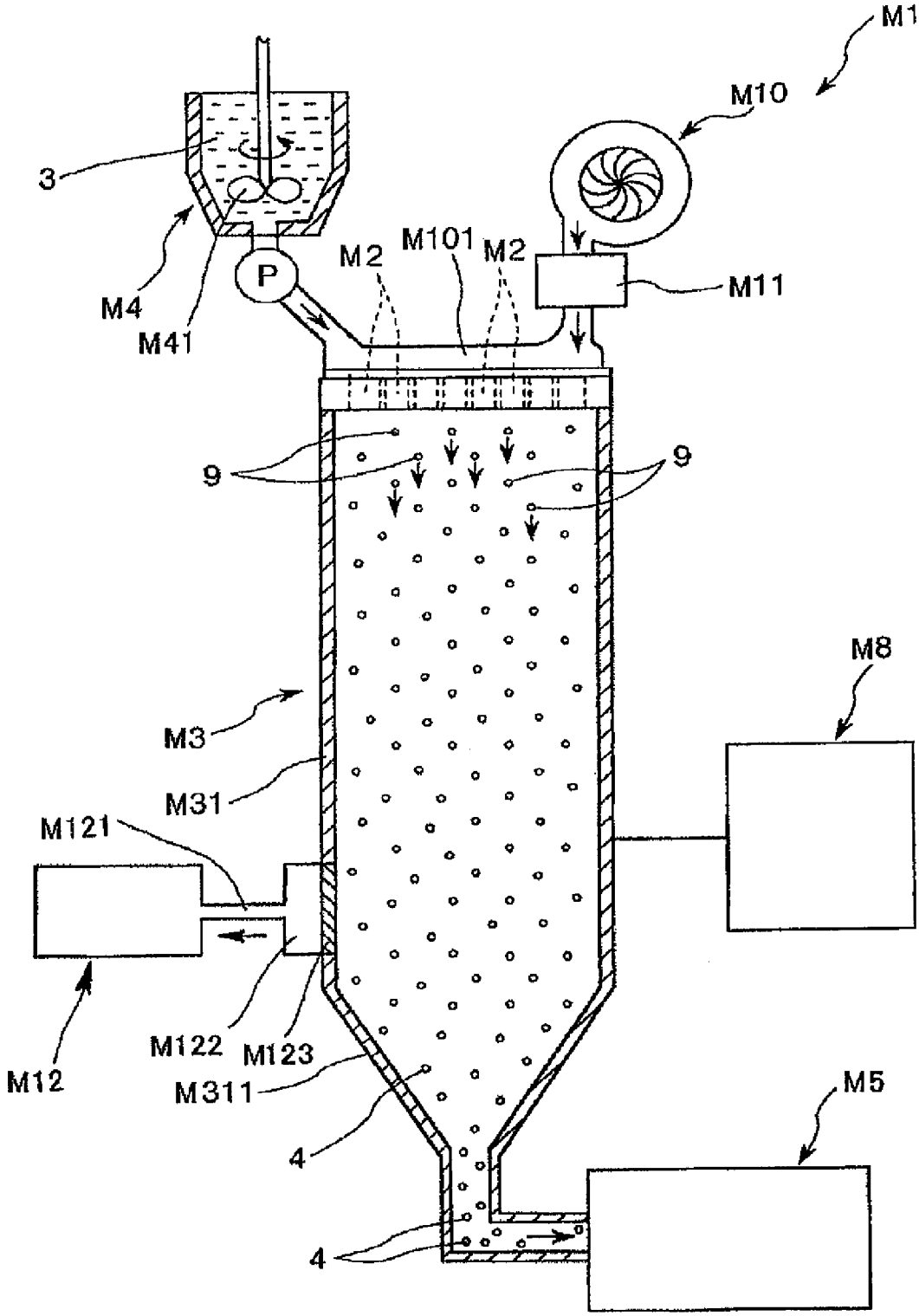
FIG. 2 is a vertical cross-sectional view which schematically shows one example of a toner matrix particle producing apparatus (an apparatus for producing toner particles) used in producing a liquid developer according to the present invention.
Figure 3:
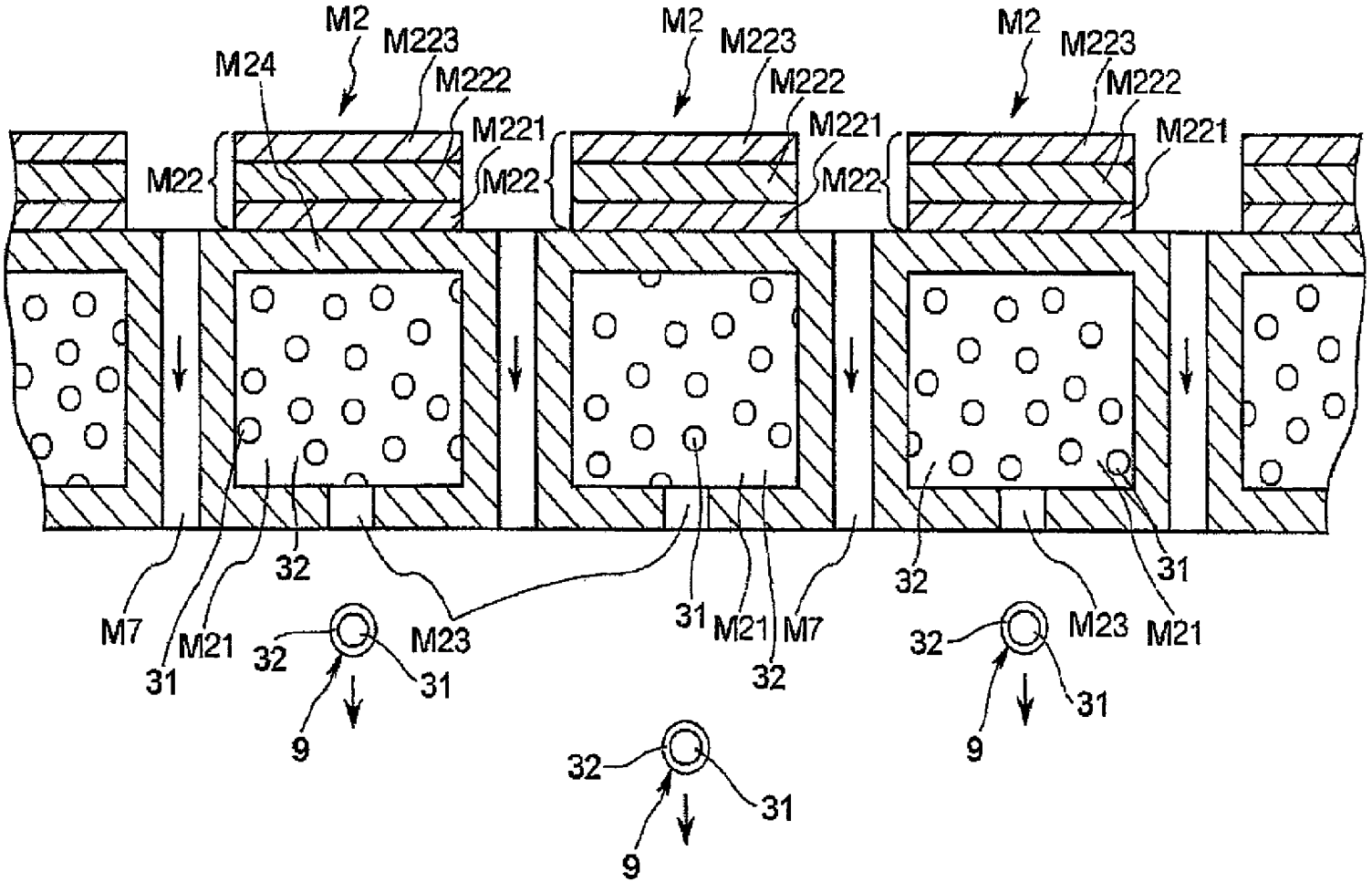
FIG. 3 is an enlarged sectional view of a head portion of the toner matrix particle producing apparatus shown in FIG. 2.

FIG. 1 is a vertical cross-sectional view which schematically shows one example of the structure of a kneading machine and a cooling machine both used for producing a kneaded material used for preparing a water-based emulsion, FIG. 2 is a vertical cross-sectional view which schematically shows a preferred embodiment of a toner matrix particle producing apparatus used in producing a liquid developer according to the present invention, and FIG. 3 is an enlarged sectional view of a head portion of the toner matrix particle producing apparatus shown in FIG. 2. In the following description, the left side in FIG. 1 denotes "base" or "base side" and the right side in FIG. 1 denotes "front" or "front side".

Various methods can be used for producing the liquid developer of the present invention. However, the production method described below comprises a dispersion liquid preparing step of preparing a dispersion liquid which includes a dispersion medium and a dispersoid constituted from the toner material described above and dispersed in the dispersion medium, a dispersion medium removing step of removing the dispersion medium to obtain toner matrix particles, and a dispersing step of dispersing the toner matrix particles into an insulation liquid while a polymeric dispersant is allowed to adhere to the surfaces of the toner matrix particles.

Hereinbelow, a description will be made with regard to the example in which a water-based dispersion liquid which includes a water-based dispersion medium constituted from a water-based liquid and a dispersoid dispersed in the dispersion medium is used as the dispersion liquid. By using such a water-based dispersion liquid, it is possible to provide a liquid developer which is harmless to environment.

The water-based dispersion liquid may be prepared by any method, but in the following example the dispersion liquid is prepared using a kneaded material containing a resin material and a coloring agent.

In this regard, it is to be noted that constituent materials (components) of the kneaded material may contain a component used as a solvent such as an inorganic solvent or an organic solvent besides the toner material described above. This makes it possible to improve effficiency of the kneading process, thereby enabling to obtain a kneaded material in which the respective components are homogeneously mixed to each other with ease.

<Kneaded Material>

Hereinbelow, a description will be made with regard to one example of a method for obtaining a kneaded material K7 by kneading a material K5 which contains the above-mentioned toner material.

The kneaded material K7 can be manufactured using a kneading apparatus as shown in FIG. 1.

<Kneading Step>

The material K5 to be kneaded contains the constituent materials of the toner matrix particles as described above. In this regard, it is to be noted that the coloring agent is likely to contain air therein, and thus such air is also contained in the material K5 in the form of air bubbles, which means that there is a possibility that such air bubbles could enter the inside of the toner particle. However, since the material K5 is subjected to the kneading process in this step, it is possible to eliminate air (air bubbles) contained in the material K5 efficiently, and therefore it is possible to prevent air bubbles from entering the inside of the toner particle effectively, that is, prevent air bubbles from remaining inside the toner particle effectively. Therefore, it is preferred that the material K5 to be kneaded is prepared in advance by mixing the above-mentioned various components.

In this embodiment, a biaxial kneader-extruder is used as the kneading machine, a detail of which will be described below.

The kneading machine K1 includes a process section K2 which kneads the material K5 while conveying it, a head section K8 which extrudes a kneaded material K7 so that an extruded kneaded material can have a prescribed cross-sectional shape, and a feeder K4 which supplies the material K5 into the process section K2.

The process section K2 has a barrel K21, screws K22 and K23 inserted into the barrel 21, and a fixing member K24 for fixing the head section K3 to the front portion of the barrel K21.

In the process section K2, a shearing force is applied to the material K5 supplied from the feeder K4 by the rotation of the screws K22 and K23 so that a homogeneous kneaded material K7 is obtained.

In this embodiment, it is preferred that the total length of the process section K2 is in the range of 50 to 300 cm, and more preferably in the range of 100 to 250 cm. If the total length of the process section K2 is less than the above lower limit value, there is a case that it is difficult to mix and knead the components in the material K5 homogeneously. On the other hand, if the total length of the process section K2 exceeds the above upper limit value, there is a case that thermal modification of the material K5 is likely to occur depending on the temperature inside the process section K2, or the number of revolutions of the screws K22 and K23, or the like, thus leading to a possibility that it becomes difficult to control the physical properties of a finally obtained liquid, developer (that is, a resultant liquid toner) sufficiently.

In this connection, when the temperature of the material (material temperature) during the kneading step is preferably in the range of 80 to 260° C., and more preferably in the range of 90 to 230° C. though it varies depending on the composition of the material K5 and the like. In this regard, it is to be noted that the temperature of the material inside the process section K2 may be constant throughout the process section K2 or different depending on positions inside the process section K2. For example, the process section K2 may include a first region in which an internal temperature is set to be relatively low, and a second region which is provided at the base side of the first region and in which an internal temperature is set to be higher than the internal temperature of the first region.

Moreover, it is preferred that the residence time of the material K5 in the process section K2, that is the time required to pass through the process section K2, is 0.5 to 12 minutes, and more preferably 1 to 7 minutes. If the residence time of the material K5 in the process section K2 is less than the above lower limit value, there is a possibility that it is difficult to mix the components in the material K5 homogeneously. On the other hand, if the residence time of the material K5 in the process section K2 exceeds the above upper limit value, there is a possibility that production efficiency is lowered, and thermal modification of the material K5 is likely to occur depending on the temperature inside the process section 2 or the number of revolutions of the screws K22 and K23, or the like, thus resulting in a case that it is difficult to control the physical properties of a finally obtained liquid developer (that is, a resultant liquid toner) satisfactorily.

Although the number of revolutions of the screws K22 and K23 varies depending on the compositions of the binder resin or the like, 50 to 600 rpm is preferable. If the number of revolutions of the screws K22 and K23 is less than the above lower limit value, there is a case that it is difficult to mix the components of the material K5 homogeneously. On the other hand, if the number of revolutions of the screws K22 and K23 exceeds the above upper limit value, there is a case that molecular chains of the resin are cut due to a shearing force, thus resulting in deterioration of the characteristics of the resin.

In the kneading machine K1 used in this embodiment, the inside of the process section K2 is connected to a pump P through a duct K25. This makes it possible to deaerate the inside of the process section K2, thereby enabling to prevent the pressure inside the process section K2 from raising due to heated-up or heat generation of the material K5 (kneaded material K7). As a result, the kneading step can be carried out safely and effectively. Further, since the inside of the process section K2 is connected to the pump P through the duct K25, it is possible to prevent effectively air bubble (in particular, relatively large air bubble) from being contained, so that it becomes possible to obtain a liquid developer (that is, a liquid toner) having excellent properties.

<Extrusion Process>

The kneaded material K7 which has been kneaded in the process section K2 is extruded to the outside of the kneading machine K1 via the head section K3 by the rotation of the screws K22 and K23.

The head section K3 has an internal space K31 to which the kneaded material K7 is sent from the process section K2, and an extrusion port K32 through which the kneaded material K7 is extruded.

In this connection, it is preferred that the temperature of the kneaded material K7 in the internal space K31 (the temperature of the kneaded material K7 at least in the vicinity of the extrusion port K32) is higher than a softening temperature of the resin materials contained in the material K5. When the temperature of the kneaded material K7 is set to be such a temperature, it is possible to obtain a toner particle in which the components thereof are homogeneously mixed, thereby enabling to make variations in its properties such as chargeable characteristics, fixing characteristics (electrification properties), and the like small.

The concrete temperature of the kneaded material K7 inside the internal space K31 (that is, the temperature of the kneaded material K7 at least in the vicinity of the extrusion port K32) is not limited to a specific temperature, but is preferably in the range of 80 to 150° C., and more preferably in the range of 90 to 140° C. In the case where the temperature of the kneaded material K7 in the internal space K31 is within the above range, the kneaded material K7 is not solidified inside the internal space K31 so that it can be extruded from the extrusion port 32K easily.

The internal space K31 having a structure as shown in FIG. 1 includes a cross sectional area reduced portion K33 in which a cross sectional area thereof is gradually reduced toward the extrusion port K32. Due to the provision of the cross sectional area reduced portion K33, the extrusion amount of the kneaded material K7 which is to be extruded from the extrusion port 32K becomes stable, and the cooling rate of the kneaded material K7 in a cooling process which will be described later also becomes stable. As a result of this, variations in properties of each toner particle can be made small, whereby enabling to obtain a liquid developer (that is, a liquid toner) having excellent properties.

<Cooling Process>

The kneaded material K7 in a softened state extruded from the extrusion part K32 of the head section 3 is cooled by a cooler K6 and thereby it is solidified.

The cooler K6 has rolls K61, K62, K63 and K64, and belts K65 and K66.

The belt K65 is wound around the rolls K61 and K62, and similarly, the belt 66 is wound around the rolls K63 and K64.

The rolls K61, K62, K63 and K64 rotate in directions shown by the arrows e, f, g and h in the drawing about rotary shafts K611, K621, K631 and K641, respectively. With this arrangement, the kneaded material K7 extruded from the extrusion port K32 of the kneading machine K1 is introduced into the space between the belts K65 and K66. The kneaded material K7 is then cooled while being molded into a plate-like object with a nearly uniform thickness, and is then ejected from an ejection part K67. The belts K65 and K66 are cooled by, for example, an air cooling or water cooling method. By using such a belt type cooler, it is possible to prolong a contact time between the kneaded material extruded from the kneading machine and the cooling members (belts), thereby enabling the cooling efficiency for the kneaded material to be especially excellent.

Now, during the kneading process, since the material K5 is subjected to a shearing force, phase separation (in particular, macro-phase separation) can be prevented. However, since the kneaded material K7 which went through the kneading process is free from the shearing forcer there is a possibility that phase separation (in particular, macro-phase separation) will occur again if such a kneaded material is being left standing for a long period of time. Accordingly, it is preferable to cool the thus obtained kneaded material K7 as quickly as possible. More specifically, it is preferred that the cooling rate (for example, the cooling rate when the kneaded material K7 is cooled down to about 60° C.) of the kneaded material K7 is faster than 3° C./s, and more preferably in the range of 5 to 100° C./s. Moreover, the time between the completion of the kneading process (at which no shearing force is applied) and the completion of the cooling process (time required to lower the temperature of the kneaded material K7 to 60° C. or lower, for example) is preferably 20 seconds or less, and more preferably 3 to 12 seconds.

In the above embodiment, a description has been made in terms of an example using a continuous type biaxial kneader-extruder as the kneading machine, but the kneading machine used for kneading the material is not limited to this type. For kneading the material, it is possible to use various kinds of kneading machines, for example, a kneader, a batch type triaxial roll, a continuous type biaxial roll, a wheel mixer, a blade mixer, or the like.

Further, although in the embodiment shown in the drawing the kneading machine is of the type that has two screws, the number of screws may be one or three or more. Further, the kneading machine may have a disc section (kneading disc section).

Furthermore, in the embodiment described above, one kneading machine is used for kneading the material, but kneading may be carried out using two kneading machines. In this case, the heating temperature of the material and the rotational speed of the screws of one kneading machine may be different from those of the other kneading machine.

Moreover, in the above embodiment, the belt type cooler is used, but a roll type (cooling roll type) cooler may be used. Furthermore, cooling of the kneaded material extruded from the extrusion port K32 of the kneading machine is not limited to the way using the cooler described above, and it may be carried out by air cooling, for example.

<Grinding Process>

The kneaded material K7 obtained through the cooling process described above is ground. By grinding the kneaded material K7, it is possible to obtain a water-based emulsion (described later) in which a fine dispersant is dispersed relatively easily. As a result, it becomes possible to make the size of the toner particles smaller in a liquid developer finally obtained, and such a liquid developer can be preferably used in forming a high resolution image.

The method of grinding is not particularly limited. For example, such grinding may be carried out by employing various kinds of grinding machines or crushing machines such as a basil mill, a vibration mill, a jet mill, a pin mill, or the like.

The grinding process may be carried out by dividing it into a plurality of stages (for example, two stages of coarse and fine grinding processes). Further, after the grinding process, other treatment such as classification treatment may be carried out as needed. Such classification treatment may be carried out using a sieve or an air flow type classifier or the like.

By subjecting the material K5 to the kneading process as described above, it is possible to eliminate air contained in the material K5 effectively. In other words, the kneaded material K7 obtained through such a kneading process does not contain air (air bubble) in the inside thereof. By using such kneaded material K7, it is possible to prevent formation of toner particles of irregular shapes (such as void particles, defect particles, fused particles, and the like) effectively. As a result, in a liquid developer finally obtained, it is possible to prevent occurrence of a problem such as lowered transfer property and cleaning property which are caused by such toner particles having irregular shapes.

In this embodiment, a water-based emulsion is prepared using the kneaded material K7 described above.

By using the kneaded material K7 in preparing the water-based emulsion, the following effects can be obtained. Namely, even in the case where a constituent material of toner particles contains components which are difficult to be dispersed in a dispersion medium or difficult to be mutually soluble to each other, these components are mutually soluble to each other satisfactorily and finely dispersed in an obtained kneaded material by way of the kneading step described above. In particular, most of pigments (coloring agent) have poor dispersibility to a liquid used as a solvent. However, in this embodiment, because the kneading step has been carried out before the kneaded material is dispersed into a solvent, the outer periphery of each particle of a pigment is coated with a resin component effectively. Therefore, since dispersibility of the pigment to the solvent is improved (particularly, the pigment can be finely dispersed in the solvent), color development of a finally obtained liquid developer becomes excellent. For these reasons, even in the case where a constituent material of toner particles contains a component having poor dispersibility to a dispersion medium of a water base-emulsion (water-based solvent) which will be described later (hereinafter, this component will be referred to as "poor dispersibility component") or a component having poor solubility to a solvent contained in a dispersion medium of a water-based emulsion (hereinafter, this component will be referred to as "poor solubility component"), it is possible to make dispersibility of a dispersoid in a water-based emulsion more excellent. Further, in a water-based suspension 3 (droplets 9), dispersibility of a dispersoid 31 becomes excellent. With these results, in a finally obtained liquid developer, variations in compositions and properties of respective toner particles can be made small, and therefore the liquid developer can have excellent properties as a whole.

On the other hand, in the case where a material which has not been kneaded is used in preparing a water-based emulsion, a poor dispersibility component and/or a poor solubility component are aggregated and then the aggregates thereof settle down in a water-based emulsion or a water-based suspension described later. As a result, a dispersoid comprised of relatively large particles, which are mainly constituted from the poor dispersibility component and/or poor solubility component and which have not been sufficiently mixed with other components, exists in the water based-emulsion (and the water based suspension). That is, a dispersoid comprised of large particles which are mainly constituted from the poor dispersibility component and/or poor solubility component and a dispersoid comprised of particles constituted from components other than the poor dispersibility component or poor solubility component exist in a water-based emulsion and/or a water-based suspension in a mixed state. Accordingly, toner matrix particles obtained in the water-based dispersion medium removal step described later are apt to have large variations in compositions, size and shape of the respective toner matrix particles. As a result, properties of a liquid developer obtained are lowered as a whole.

Further, in the case where particles obtained by grinding the kneaded material are used as toner matrix particles as they are without being used in preparing a water-based emulsion as described later, there is a limit on raising homogeneity (uniformity) of the components in the toner matrix particles. Further, according to this method, it is particularly difficult to disperse or finely disperse a pigment which is generally in the form of relatively ridged aggregates (which is likely to be in the form of ridged aggregates).

In contrast, according to this embodiment, since the kneaded material described above is used in preparing a water-based emulsion, it is possible to obtain toner matrix particles in which the respective components are dispersed (finely dispersed) or mutually dissolved sufficiently homogeneously.

Further, in the water-based emulsion used in this embodiment, a dispersoid is in a liquid sate (that is, a dispersoid has fluidity so that it can be deformed relatively easily), there is a tendency that each dispersoid is formed into a shape having a relatively high roundness (sphericity) due to its surface tension. Accordingly, in a suspension (water-based suspension) prepared using the water-based emulsion, there is also a tendency that each dispersoid (that is, each toner matrix particle) is formed into a shape having a relatively high roundness (sphericity). Further, in the emulsion containing a dispersoid in a liquid state (that is, a dispersoid having fluidity so that it can be deformed relatively easily), it is possible to raise uniformity in the size of the respective particles of the dispersoid relatively easily by stirring the emulsion. In contrast, in the case where resin particles which are prepared without the water-based emulsion process are used in a suspension which is used for producing toner matrix particles described later, a dispersoid contained in the suspension is likely to have low roundness, so that variations in the shape or particle size (diameter) of the respective particles become larger. In this connection, in order to suppress such variations in their shape, it may be conceived that a heat spheronization treatment is carried out when toner matrix particles are being formed or after toner matrix particles have been formed. However, in such a case (particularly, when such a heat spheronization treatment is carried out when toner matrix particles are being formed), it is difficult to make the variations in shapes of the obtained toner matrix particles sufficiently small unless otherwise conditions for the heat spheronization treatment are set to be relatively severe. Further, such severe conditions for the heat spheronization treatment in turn involve such problems in that deterioration of the constituent material of the toner matrix particles is likely to occur and a mutually dissolved state and a finely dispersed state of the components in the respective toner matrix particles are likely to occur, and thereby it becomes difficult for a finally obtained liquid developer to exhibit sufficient properties.

<Water-based Emulsion Preparing Step>

Next, by using the kneaded material K7, a water-based emulsion comprised of a water-based dispersion medium constituted from a water-based solvent in which a dispersoid constituted from a constituent material of the toner matrix particles is dispersed is prepared (water-based emulsion preparing step). In this step, if the kneaded material K7 contains a polyester resin of the type that has an anionic group, a water-based emulsion obtained in this step can have a satisfactory dispersion state of a dispersoid. Further, since a water-based liquid is used as a dispersion medium, it is possible to produce a liquid developer with a method harmless to environment.

The method for preparing the water-based emulsion is not particularly limited, but in the present embodiment, a water-based emulsion is prepared by obtaining a solution in which at least a part of the kneaded material K7 is dissolved, and then by dispersing such a solution into a water-based solvent. In this connection, it should be noted that in this specification the term "emulsion" means a dispersion liquid comprised of a liquid state dispersion medium and a liquid state dispersoid (dispersion particles) dispersed in the dispersion medium, and the term "suspension" means a dispersion liquid (including suspension colloid) comprised of a liquid state dispersion medium and a solid state dispersoid (suspension particles) dispersed in the dispersion medium. Further, in the case where a liquid state dispersoid and a solid state dispersoid exist in a dispersion liquid, the term "emulsion" means a dispersion liquid in which the total volume of the liquid state dispersoid is larger than the total volume of the solid state dispersoid, while the term "suspension" means a dispersion liquid in which the total volume of the solid state dispersoid is larger than the total volume of the liquid state dispersoid.

Hereinbelow, a description will be made with regard to the method for preparing the water-based emulsion.

<Preparation of Kneaded Material Solution>

In the present embodiment, a kneaded material solution (a solution of the kneaded material) in which at least a part of the kneaded material is dissolved is obtained.

The solution can be prepared by mixing the kneaded material with a solvent in which at least a part of the kneaded material can be dissolved.

As for the solvent used for preparing the solution, various solvents can be used so long as at least a part of the kneaded material can be dissolved thereinto, but normally, solvents which have low mutual solubility to a water-based liquid described later (that is, a water-based liquid used for preparing the water-based emulsion) are used. For example, a liquid having a solubility of 10 g or less with respect to 100 g of a water-based liquid at a temperature of 25° C. is used.

Examples of such solvents include inorganic solvents such as carbon disulfide, and carbon tetrachloride, and organic solvents such as ketone-based solvents (e.g., methyl ethyl ketone (MEK), methyl isopropy). ketone (MIPK), and 2-heptanone), alcohol-based solvents (e.g., pentanol, n-hexanol, 1-octanol, and 2-octanol), ether-based solvents (e.g., diethyl ether, and anisole), aliphatic hydrocarbon-based solvents (e.g., hexane, pentane, heptane, cyclohexane, octane, and isoprene), aromatic hydrocarbon-based solvents (e.g., toluene, xylene, benzene, ethyl benzene, and naphthalene), aromatic heterocyclic compound-based solvents (e.g., furan, and thiophene), halide-based solvents (e.g., chloroform), ester-based solvents (e.g., ethyl acetate, isopropyl acetate, isobutyl acetate, and ethyl acrylate), nitrile-based solvents (e.g., acrylonitrile), and nitro-based solvents (e.g., nitromethane and nitroethane). These materials can be used singly or in combination of two or more of them.

The amount of the solvent contained in the solution is not limited to any specific value, but is preferably in the range of 5 to 75 wt %, more preferably in the range of 10 to 70 wt %, and even more preferably in the range of 15 to 65 wt %. If the amount of the solvent contained in the solution is less than the above lower limit value, there is a possibility that it is difficult to dissolve the kneaded material sufficiently depending on the solubility of the kneaded material to the solvent. On the other hand, if the amount of the solvent exceeds the above upper limit value, a time required for removing the solvent in the subsequent step becomes long, and as a result, the productivity of the liquid development is lowered. Further, if the amount of the solvent is too much, there is a possibility that the components which were sufficiently and homogeneously mixed to each other are phase-separated, and thereby making it difficult to make variations in the properties of the toner particles of a finally obtained liquid developer sufficiently small.

In this regard, it is to be noted that it is sufficient that at least a part of the components which constitute the kneaded material is dissolved (including a swelling state), and therefore components which were not dissolved may exist in the solution.

<Preparation of Water-based Emulsion>

Next, a water-based emulsion is obtained by mixing the above mentioned solution with a water-based liquid. Normally, in the thus obtained water-based emulsion, a dispersoid which contains the solvent and the constituent material of the kneaded material are dispersed in the water-based dispersion medium formed from the water-based liquid.

In this regard, it is to be noted that in this specification the term "water-based liquid" means a liquid containing at least water ($H_2O$), and preferably a liquid mainly constituted from water. The amount of the water contained in the water-based liquid is preferably 50 wt % or more, more preferably 80 wt % or more, and most preferably 90 wt % or more.

The water-based liquid may contain components other than the water. For example, the water-based liquid may contain other components having good compatibility with water (for example, a liquid which has solubility of 30 g or higher with respect to 100 g of water at temperature of 25° C.).

Examples of such a water-based liquid include water, alcohol-based solvents such as methanol, ethanol, propanol, and the like, ether-based solvents such as 1,4-dioxane, tetrahydrofuran (THF), and the like, aromatic heterocyclic compound-based solvents such as pyridine, pyrazine, pyrrole, and the like, amide-based solvents such as N,N-dimethylformamide (DMF), N,N-dimethylacetamide (DMA), and the like, nitrile-based solvents such as acetonitrile and the like, and aldehyde-based solvents such as acetaldehyde, and the like.

Further, in preparing the water-based emulsion, a surfactant or the like may be used for the purpose of improving the dispersibility of the dispersant.

It is preferred that the solution is mixed with the water-based liquid while at least one of the solution or the water-based liquid is being stirred. This makes it possible to obtain an emulsion (a water-based emulsion) in which a dispersoid having small variations in its size and shape is homogeneously dispersed easily and reliably.

Examples of methods for mixing the solution and the water-based liquid include a method in which the solution is added (for example, dropped) into the water-based liquid contained in a container, a method in which the water-based liquid is added (for example, dropped) into the solution contained in a container, and the like. In these methods, the water-based liquid or the solution which is contained in a container is preferably being stirred. This makes it possible to exhibit the above effect more conspicuously.

The amount of the disporsoid in the water-based emulsion is not particularly limited, but preferably in the range of 5 to 55 wt %, and more preferably in the range of 10 to 50 wt %. This makes it possible to prevent bonding or aggregation of particles of the dispersoid more reliably, thereby enabling to make productivity of the toner particles (liquid developer) particularly superior.

The average diameter of the particles of the dispersoid in the water-based emulsion is not particularly limited, but preferably in the range of 0.01 to 5 μm, and more preferably in the range of 0.1 to 3 μm. This makes it possible to prevent bonding or aggregation of the particles of the dispersoid in the water-based emulsion more reliably, thereby enabling to make the size of the toner particles finally obtained optimum In this regard, it is to be noted that the term "average diameter" means an average diameter per the reference volume of particles.

Further, although the above description was made with regard to the case that the components of the kneaded material are contained in the dispersoid in the water-based emulsion, a part of the components of the kneaded material may be contained in the dispersion medium.

Furthermore, the water-based emulsion may contain additional components other than the above-mentioned components. Examples of such additional components include a charge controlling agent, magnetic powder and the like.

Example of the charge controlling agent include metal salts of benzoic acid, metal salts of salicylic acid, metal salts of alkyl salicylic acid, metal salts of catechol, metal-containing bisazo dyes, nigrosine dyes, tetraphenylborate derivatives, quaternary ammonium salts, alkyl pyridinium salts, chlorinated polyesters, nitrohumic acid, and the like.

Further, examples of the magnetic powders include powders of metal oxides such as magnetite, maghemite, various ferrites, cupric oxide, nickel oxide, zinc oxide, zirconium oxide, titanium oxide, magnesium oxide, and the like, and powders of magnetic materials containing magnetic metals such as Fe, Co, and Ni.

The water-based emulsion may further contain, for example, zinc stearate, zinc oxide, or cerium oxide, in addition to the above-mentioned materials.

<Preparation of Water-based Suspension>

The thus obtained water-based emulsion may be used in the water-based dispersion medium removal step described below as it is. However, in the present embodiment, a water-based suspension 3 comprised of a dispersion medium (water-based dispersion medium) and a solid state dispersoid 31 dispersed in the dispersion medium is obtained based on the water-based emulsion (in which the liquid state dispersant is dispersed in the water-based dispersion medium), and the thus obtained water-based suspension is used in the water-based dispersion medium removal step. This makes it possible to prevent undesirable aggregation of the particles in the water-based dispersion medium removal step more effectively, and as a result thereof, the uniformity in the shape and size of the toner particles can be made especially excellent. Further, in the case where a dispersoid of the water-based emulsion is constituted from such a material containing a polyester resin having an anionic group which has good compatibility with the water-based liquid, a water-based suspension obtained in this step can also have especially excellent dispersibility of the dispersoid.

Hereinbelow, a detailed description will be made with regard to a method for preparing the water-based suspense on 3.

The water-based suspension 3 can be prepared by removing the solvent which constitutes the dispersion medium from the water-based emulsion.

The removal of the solvent can be carried out, for example, by heating or warming the water-based emulsion or placing it in an atmosphere under reduced pressure. However, it is preferred that the water-based emulsion is heated under reduced pressure. This makes it possible to obtain a water-based suspension 3 containing a dispersoid 31 having particularly small variations in size and shape thereof relatively easily. Further, by removing the solvent as described above, it is possible to carry out a deaerating treatment in addition to the removal of the solvent. By the deaerating treatment, it is possible to reduce the amount of the dissolved air in the water-based suspension 3, and therefore when the dispersion medium 32 is removed from the droplets 9 of the water-based suspension 3 in the water-based dispersion medium removal section M3 of the toner matrix particle producing apparatus M1, it is possible to prevent generation of air bubble in the water-based suspension 3 in an effective manner. As a result, it is possible to prevent toner particles having irregular shapes (such as void particles and defect particles) from entering (or being mixed into) a finally obtained liquid developer effectively.

When the water-based emulsion is heated (or warmed), the heating temperature is preferably in the range of 30 to 110° C., and more preferably in the range of 40 to 100° C. If the heating temperature is set to a value within the above range, it is possible to remove the solvent immediately while preventing generation of a dispersoid 31 having irregular shapes effectively (that is, preventing rapid vaporization (boiling) of a solvent from the inside of the dispersoid in the water-based emulsion).

Further, when the water-based emulsion is placed in an atmosphere under reduced pressure, the pressure of the atmosphere in which the water-based emulsion is placed is preferably in the range of 0.1 to 50 kPa, and more preferably in the range of 0.5 to 5 kPa. If the pressure of the atmosphere in which the water-based emulsion is within the above range, it is possible to remove the solvent immediately while preventing generation of a dispersoid (particles) 31 having irregular shapes effectively (that is, preventing rapid vaporization (boiling) of a solvent from the inside of the dispersoid of the water-based emulsion).

In this regard, it should be noted that it is sufficient that the removal of the solvent is carried out to the extent that at least the dispersoid is transformed into a solid state. It is not necessary to remove substantially all the solvent contained in the water-based emulsion.

The average diameter of the particles of the dispersoid 31 contained in the water-based suspension 3 is not limited to a specific valuer but preferably in the range of 0.01 to 5 μm, and more preferably in the range of 0.1 to 3 μm. This makes it possible to prevent bonding (aggregation) of the particles of the dispersoid reliably, thereby enabling the size of finally obtained toner particles to be optimum size.

<Water-based Dispersion Medium Removal Step>

Next, by removing the water-based dispersion medium from the water-based dispersion liquid (water-based suspension 3), toner matrix particles corresponding to the particles of the dispersoid in the water-based dispersion liquid (water-based suspension 3) are obtained (water-based dispersion medium removal step).

The removal of the water-based dispersion medium may be carried out by any method, but preferably carried out by intermittently ejecting droplets of a dispersion liquid (water-based dispersion liquid) comprised of a water-based dispersion medium and a dispersoid dispersed in the dispersion medium. This makes it possible to carry out the removal of the water-based dispersion medium efficiently while preventing aggregation of the dispersoid effectively. Further, since the removal of the water-based dispersion medium is carried out by intermittently ejecting droplets of the water-based dispersion liquid, even in the case where a part of the solvent remains in preparing the water-based suspension, it is possible to remove the remaining solvent together with the water-based dispersion medium in an effective manner.

In particular, in the present embodiment, the removal of the water-based dispersion medium is carried out using a toner matrix particle production apparatus as shown in FIGS. 2 and 3.

Toner Matrix Particle Production Apparatus

As shown in FIG. 2, the toner matrix particle production apparatus (toner particle production apparatus) M1 includes head portions M2 for intermittently ejecting the water-based suspension (water-based dispersion liquid) 3 in the form of droplets 9 as described above, a water-based suspension supply portion (water-based dispersion liquid supply portion) M4 for supplying the water-based suspension 3 to the head portions M2, a dispersion medium removal portion M3 in which the dispersion medium is removed while the water-based suspension 3 (droplets 9) in the form of droplets (fine particles) ejected from the head portions M2 is being conveyed, thereby to obtain toner matrix particles 4, and a collecting portion M5 for collecting produced toner matrix particles (toner particles) 4.

The water-base suspension supply portion M4 is not particularly limited as long as it has the function of supplying the water-based suspension 3 to the head portions M2. The water-based suspension supply portion M4 may be provided with a stirring means 41M for stirring the water-based suspension 3 as shown in FIG. 2. By providing such a stirring means 41M, even in the case where the dispersoid 31 is hard to be dispersed in the dispersion medium (water-based dispersion medium) 32, it is possible to supply the water-based suspension which is in a state that the dispersoid 31 is sufficiently homogeneously dispersed in the dispersion medium to the head portions M2.

Each of the head portions M2 has a function of ejecting the water-based emulsion 3 in the form of fine droplets (fine particles) 9.

Further, each of the head portions M2 has a dispersion liquid storage portion M21, a piezoelectric device (element) M22, and an ejection port (nozzle) M23. In the dispersion liquid storage portion M21, the water-based suspension 3 is stored.

The water-based suspension 3 stored in the dispersion liquid storage portion M21 is ejected from the ejection port M23 in the form of droplets 9 into the dispersion medium removal portion M3 when a pressure pulse (piezoelectric pulse) is applied.

The shape of the ejection portion M23 is not particularly limited, but preferably it is formed into a substantially circular shape. By forming the ejection portion M23 into such a shape, it is possible to raise sphericity of the ejected water-based suspension 3 and the toner matrix particles 4 to be formed in the dispersion medium removal portion M3.

When the ejection portion M23 has such a substantially circular shape, the diameter thereof (that is, nozzle diameter) is preferably in the range of 5 to 500 μm, and more preferably in the range of 10 to 200 μm. If the diameter of the ejection portion M23 is less than the above lower limit value, clogging is likely to occur and therefore there is a case that variations in the size of the droplets 9 to be ejected become larger. On the other hand, if the diameter of the ejection portion M23 exceeds the above upper limit value, there is a possibility that the water-based suspension 3 (droplets 9) to be ejected contains air bubbles inside thereof depending on the relative power balance between the negative pressure of the dispersion liquid storage portion M21 and the surface tension at the nozzle.

Further, it is preferred that the a portion in the vicinity of the ejection portion M23 of each head portion M2 (that is, an inner surface of the nozzle aperture of each ejection portion M23 and a surface of the head portions M2 in which the ejection portions M23 are provided (the lower surface in the drawing)) has a liquid repellency (water repellency). This makes it possible to prevent the water-based suspension 3 from adhering around the ejection portion effectively. As a result, it is possible to prevent a poor formation of droplets and occurrence of defective ejection of the water-based suspension 3. Further, since adhering of the water-based suspension 3 around the ejection portion is prevented effectively, the shape stability of the droplets to be ejected is improved (variations in shape and size of the respective droplets are made small), and thus variations in shape and size of finally obtained toner particles can be made small.

Examples of a material having such a liquid repellency include fluorobased resins such as polytetrafluoroetylene (PTFE) and silicone-based materials.

As shown in FIG. 3, each of the piezoelectric devices M22 is formed by laminating a lower electrode (a first electrode) M221, a piezoelectric element M222, and an upper electrode (a second electrode) M223 in this order from the bottom side. In other words, each of the piezoelectric devices M22 has a structure in which the piezoelectric element M222 is provided between the upper electrode M223 and the lower electrode M221.

The piezoelectric device M22 functions as a vibration source, and the diaphragm M24 is vibrated by the piezoelectric device (vibration source) M22 to instantaneously increase the internal pressure of the ejection liquid storage portion M21.

In particular, in each of the head portions M2, the piezoelectric element M222 keeps its original shape in a state where a predetermined eject signal from a piezoelectric device driving circuit (not shown in the drawings) is not inputted, that is, in a state where no voltage is applied across the lower electrode M221 and the upper electrode M223 of the piezoelectric device M22. At this time, since the diaphragm M24 also keeps its original shape, the volume of the dispersion liquid storage portion M21 is not changed. That is, the water-based suspension 3 is not ejected through the ejection portion M23.

On the other hand, the piezoelectric element M222 changes its shape when a predetermined eject signal from the piezoelectric device driving circuit is inputted, that is, when a predetermined voltage is applied across the lower electrode M221 and the upper electrode M223 of the piezoelectric device M22. As a result, the diaphragm M24 is significantly bent (toward the lower side in FIG. 3), so that the volume of the dispersion liquid storage portion M21 is reduced (changed). At this time, the pressure in the dispersion liquid storage portion M21 is instantaneously increased, so that the water-based suspension 3 is ejected in the form of droplets through the ejection portion M23.

When single ejection of the water-based suspension 3 is finished, namely one droplet is formed, the piezoelectric device driving circuit stops a voltage from being applied across the lower electrode M221 and the upper electrode M223. As a result, the piezoelectric device M22 is returned to its almost original shape so that the volume of the ejection liquid storage portion M21 is increased. At this time, since pressure is exerted on the water-based suspension 3 in the direction from the water-based suspension supply portion M4 to the ejection portion M23 (that is, in the positive direction), it is possible to prevent air from entering the dispersion liquid storage portion M21 through the ejection portion M23. Then, the water-based suspension 3 in an amount equal to the ejected amount thereof is supplied to the dispersion liquid storage portion M21 from the water-based suspension supply portion M4.

By carrying out predetermined periodic application of a voltage in such a manner as described above, the water-based suspension 3 in the form of a droplet is repeatedly ejected due to vibration of the piezoelectric device M22.

As described above, by carrying out ejection (discharge) of the water-based suspension 3 by the use of a pressure pulse due to vibration of the piezoelectric element M222, it is possible to eject the water-based suspension 3 intermittently drop by drop with the shape of each droplet 9 being stable. As a result, it is possible to make variations in shape and size of respective toner matrix particles extremely small, thereby enabling to produce toner matrix particles having high sphericity (a shape close to a geometrically perfect spherical shape) relatively easily.

Further, by ejecting the dispersion liquid by the use of vibration of the piezoelectric element, it is possible to eject the dispersion liquid at predetermined intervals more reliably. This makes it possible to effectively prevent collision or aggregation between the ejected droplets 9 of the dispersion liquid, thus resulting in preventing formation of defective toner matrix particles 4 effectively.

The initial velocity of the water-based suspension 3 (droplets 9) at the time when the water-based suspension 3 is ejected from the head portions M2 into the dispersion medium removal portion. M3 is preferably in the range of, for example, 0.1 to 10 m/sec, more preferably in the range of 2 to 8 m/sec. If the initial velocity of the water-based suspension 3 is less than the above lower limit value, productivity of toner matrix particles is lowered. On the other hand, the initial velocity of the water-based suspension 3 exceeds the above upper limit value, the obtained toner matrix particles tend to have a lower degree of sphericity.

The viscosity of the water-based suspension 3 ejected from the head portions M2 is not limited to any specific value, but is preferably in the range of, for example, 0.5 to 200 (mPa·s), more preferably in the range of 1 to 25 (mPa·s). If the viscosity of the water-based suspension 3 is less than the above lower limit value, it is difficult to control the size of each droplet of the water-based suspension to be ejected properly, thus resulting in a case where the obtained toner matrix particles have large variations in their particle size. On the other hand, if the viscosity of the water-based suspension 3 exceeds the above upper limit value, there is a tendency that each of the formed droplets has a larger diameter, the ejecting velocity of the water-based suspension 3 becomes low, and the amount of energy required to eject the water-based suspension 3 becomes large. In a case where the viscosity of the water-based suspension 3 is especially high, it is impossible to eject the water-based suspension 3 in the form of droplets.

The water-based suspension 3 to be ejected from the head portions M2 may be cooled in advance. By cooling the water-based suspension 3 in such a manner, it is possible to prevent undesirable evaporation (volatilization) of the dispersion medium 32 from the water-based suspension 3 at the vicinity of the ejection portions M23 effectively. As a result, it is possible to prevent changes in the ejected amount of the water-based suspension 3 which are caused by the fact that the diameter of each ejection portion is reduced with the elapse of time, thereby enabling to obtain toner particles having small variations in shape and size of respective particles.

The ejected amount of one droplet of the water-based suspension 3 slightly varies depending on the content of the dispersoid 31 in the water-base suspension 3, but is preferably in the range of 0.05 to 500 pl, more preferably in the range of 0.5 to 50 pl. By setting the ejected amount of one droplet of the water-based suspension 3 to a value within the above range, it is possible to obtain toner matrix particles each having an appropriate diameter (particle size).

Further, the average diameter of the droplets 9 ejected from the head portions M2 also varies depending on the content of the dispersoid 31 in the water-base suspension 3, but is preferably in the range of 1.0 to 100 μm, more preferably in the range of 5 to 50 μm. By setting the average diameter of the droplets 9 of the water-based suspension 3 to a value within the above range, it is possible to obtain toner matrix particles 4 each having an appropriate diameter.

The frequency of the piezoelectric device M22 (the frequency of an piezoelectric pulse) is not limited to any specific value, but is preferably in the range of 1 kHz to 500 MHz, more preferably in the range of 5 kHz to 200 MHz. If the frequency of the piezoelectric device M22 is less than the above lower limit value, productivity of toner matrix particles is lowered. On the other hand, if the frequency of the piezoelectric device M22 exceeds the above upper limit value, there is a possibility that the ejection of the water-based suspension 3 cannot follow the frequency of the piezoelectric device M22 so that the sizes of the droplets of the water-based suspension 3 become different from each other. As a result, there is a possibility that toner matrix particles 4 obtained have large variations in their size.

The toner matrix particle production apparatus M1 shown in FIG. 1 is provided with a plurality of head portions M2. From each of the head portions M2, a water-based emulsion 3 in the form of droplets (droplets 9) is ejected to the dispersion medium removal portion M3.

The water-based suspension 3 may be ejected at substantially the same time from all the head portions M2, but it is preferred that the water-based suspension 3 is ejected in such a manner that the timing of ejection is different in at least two adjacent head portions M2. This makes it possible to prevent collision and undesirable aggregation effectively between the water-based suspension 3 in the form of droplets, namely between the droplets 9 ejected from the adjacent head portions M2, before the toner matrix particles 4 are formed.

Further, as shown in FIG. 2, the toner matrix particle production apparatus M1 has a gas stream supply means M10, and the gas stream supply means 110 is adapted to inject gas at a substantial even pressure through a duct M101 from each of the gas injection openings M7 provided between the adjacent head portions M2. This makes it possible to convey the droplets 9 of the water-based suspension 3 intermittently ejected from the ejection portions M23 with the distance between the droplets 9 being maintained, thereby enabling to prevent collision and aggregation between the droplets effectively to obtain toner matrix particles 4. As a result, it is also possible to obtain toner matrix particles having small variations in their size and shape.

Further, by injecting gas supplied from the gas stream supply means M10 through the gas injection openings M7, it is possible to form an air stream flowing in substantially one direction (that is, in a downward direction in FIG. 1) in the dispersion medium removal portion M3. Such a gas stream makes it possible to efficiently convey the toner matrix particles 4 produced in the dispersion medium removal portion M3. As a result, collection efficiency of toner matrix particles 4 is improved and thus productivity of a liquid developer is also improved.

Furthermore, by injecting gas through the gas injection openings M7, an air flow curtain is formed between the droplets 9 ejected from the adjacent head portions M2. Such an air curtain makes it possible to prevent collision and aggregation between the droplets effectively.

The gas stream supply means M10 is equipped with a heat exchanger M11. By providing such a heat exchanger M11, it is possible to set the temperature of gas to be injected from the gas injection openings M7 to an appropriate value, thereby enabling to efficiently remove the dispersion medium 32 from the water-based suspension 3 in the form of droplets which have been ejected into the dispersion medium removal portion M3.

Further, by providing such gas stream supply means M10, it is possible to control the dispersion medium removal rate for removing the dispersion medium 32 from the droplets of the water-based suspension 3 ejected from the ejection portions M23 easily by adjusting the amount of a gas stream to be supplied.

The temperature of gas to be injected from the gas injection openings M7 varies depending on the compositions of the dispersoid 31 and the dispersion medium 32 contained in the water-based suspension 3, but is preferably in the range of 0 to 70° C., more preferably in the range of 15 to 60° C. By setting the temperature of gas to be injected from the gas injection openings M7 to a value within the above range, it is possible to remove the dispersion medium 32 effectively from the droplets 9 while maintaining shape uniformity and shape stability of the toner matrix particles 4 at a sufficiently high level.

The humidity of gas to be injected from the gas injection openings M7 is preferably 50% RH or less, more preferably 30% RH or less. By setting the humidity of gas to be injected from the gas injection openings M7 to 50% RH or less, it is possible to remove the dispersion medium 32 contained in the water-based suspension 3 efficiently in the dispersion medium removal portion M3, thereby further improving the productivity of the toner matrix particles 4.

The dispersion medium removal portion M3 is constructed from a tubular housing M31. In order to maintain the inside of the dispersion medium removal portion M3 at a temperature within a predetermined range, a heat source or a cooling source may be provided inside or outside the housing M31, or the housing M31 may be formed as a jacket having a passage of a heat medium or a cooling medium.

In the toner matrix particle production apparatus shown in FIG. 1, the pressure inside the housing M31 is adapted to be adjusted by pressure controlling means M12. By adjusting the pressure inside the housing M31, it is possible to produce toner matrix particles more effectively, and as a result, productivity of a liquid developer is improved. Further, in the structure shown in the drawing, the pressure controlling means M12 is connected to the housing M31 through a connecting pipe M121. Further, a diameter expansion portion M122 is formed in the vicinity of the end portion of the connecting pipe M121 at a side which is connected to the housing M31, and a filter M123 for preventing the toner matrix particles 4 and the like from being sucked into the pressure controlling means M12 is provided in the end of the diameter expansion portion M122.

The pressure inside the housing M31 is not limited to any specific value, but is preferably 150 kPa or less, more preferably in the range of 100 to 120 kPa, even more preferably in the range of 100 to 110 kPa. By setting the pressure in the housing M31 to a value within the above range, it is possible to prevent effectively the dispersion medium 32 from being removed rapidly from the droplets 9 (that is, boiling phenomenon of the droplets 9). As a result, it is possible to produce toner matrix particles 4 effectively while preventing formation of defective toner matrix particles 4 reliably. In this connection, it is to be noted that the pressure inside the housing M31 may be substantially the same or different from each other at various positions thereof.

Further, voltage apply means M8 for applying a voltage to the inner surface of the housing M31 is connected to the housing M31. By applying a voltage of the same polarity as the toner matrix particles 4 (droplets 9) to the inner surface of the housing M31 by the use of the voltage apply means M8, it is possible to obtain such effects as described below.

Generally, the toner matrix particles 4 are positively or negatively charged. Therefore, when there is any charged matter of polarity opposite to that of the toner matrix particles 4, the phenomenon in which the toner matrix particles 4 are electrostatically attracted to the charged matter and then adhere thereto occurs. On the other hand, when there is any charged smaller of the same polarity as that of the toner matrix particles 4, the charged matter and the toner matrix particles repel to each another, thereby effectively preventing the phenomenon in which the toner matrix particles 4 adhere to the surface of the charged matter. For this reason, by applying a voltage of the same polarity as that of the toner matrix particles 4 to the side of the inner surface of the housing M31, it is possible to prevent effectively the toner matrix particles 4 from adhering to the inner surface of the housing M31. As a result, it is also possible to prevent effectively the formation of defective toner matrix particles 4 as well as to improve the collection efficiency of the toner matrix particles 4.

The housing M31 further includes a reduced-diameter portion M311 in the bottom portion thereof. In the reduced-diameter portion M311, the inner diameter thereof is reduced toward the lower side in FIG. 2. By providing such a reduced-diameter portion M311, it is possible to collect the toner matrix particles 4 efficiently.

The toner matrix particles 4 obtained in this way are collected in the collection portion M5.

Normally, the thus obtained toner matrix particles 4 have size and shape corresponding to the respective particles of the dispersoid 31. Therefore, a finally obtained liquid developer contains toner particles each having a relatively small diameter and a high degree of roundness (sphericity) and having small variations in shape and size of the respective particles.

Further, the thus obtained toner matrix particles 4 may be particles obtained by removing the dispersion medium 32 of the water-based suspension 3, and in such a case a part of the dispersion medium may remain inside thereof.

Furthermore, the thus obtained toner matrix particles 4 may be subjected to the dispersion step described later as they are or subjected to various treatments such as heat treatment. This makes it possible to further enhance the mechanical strength (shape stability) of the toner matrix particles (toner particles) and the water content in the toner matrix particles can be reduced. Further, it is also possible to reduce the water content of the toner matrix particles 4 as is the same as the above by subjecting the thus obtained toner matrix particles to a treatment such as aeration, or placing the toner matrix particles 4 in an atmosphere under reduced pressure.

Moreover, the thus obtained toner matrix particles 4 may be subjected to other various treatments such as classification, and external addition and the like.

<Dispersion Step>

Then, the toner matrix particles 4 obtained through the above steps are dispersed in the insulation liquid so that the polymeric dispersant adhere to the surfaces of the toner matrix particles 4 (dispersion step). In this way, a liquid developer including the insulation liquid (carrier liquid) and the toner particles dispersed in the insulation liquid is obtained.

Various methods can be used for allowing the polymeric dispersant to adhere to the surfaces of the toner matrix particles 4, but it is preferred that the toner matrix particles 4 and the polymeric dispersant are added to the insulation liquid in a state that is being stirred. This makes it possible for the polymeric dispersant to adhere onto the surfaces of the toner matrix particles 4 reliably while preventing the toner matrix particles from being aggregated undesirably when preparing the liquid developer. Further, in the obtained liquid developer, a satisfactory dispersing state of the toner particles can be maintained stably for a long period of time.

The method of the stirring is not limited to any specific method, and the stirring can be carried out using a homomixer, an ultrasonic dispersion apparatus, pulprizer, planetary mill, and the like.

<Liquid Developer>

The liquid developer produced in this way has small variations in the shape and size of the toner particles. Therefore, the liquid developer is advantageous in a high speed image development since the toner particles easily migrate in the insulation liquid (in the liquid developer). Further, since the toner particles have small variation in their shape and size and the insulation liquid as described above is used, dispersibility of the toner particles is excellent, and thus settle down of the toner particles in the liquid developer is effectively prevented. Therefore, the liquid developer can have excellent preservability (storage stability).

In the foregoing, the present invention was described based on the preferred embodiments, but the present invention is not limited to these embodiments.

For example, the liquid developer of the present invention is not limited to one produced by the above described production method, and other various production methods may be used. For example, the liquid developer may be produced by wet-grinding the ground material as described above in the insulation liquid.

Further, each element constituting the toner matrix particle production apparatus may be replaced with other element that exhibits the same or similar function, or additional element may be added to the apparatus.

Furthermore, in the above described embodiments, after the toner matrix particles obtained in the water-based dispersion medium removal step are once collected, the toner matrix particles are subjected to the dispersion step. However, the toner matrix particles may be directly subjected to the dispersion step without collecting the toner matrix particles as powder. Further, the toner matrix particle production apparatus shown in the drawings may be of the type that stores a high insulation liquid therein and has a dispersion portion to which produced toner matrix particles are supplied. This makes it possible to produce a liquid developer more effectively and prevent occurrence of undesirable aggregation among the toner matrix particles more effectively.

Figure 4:
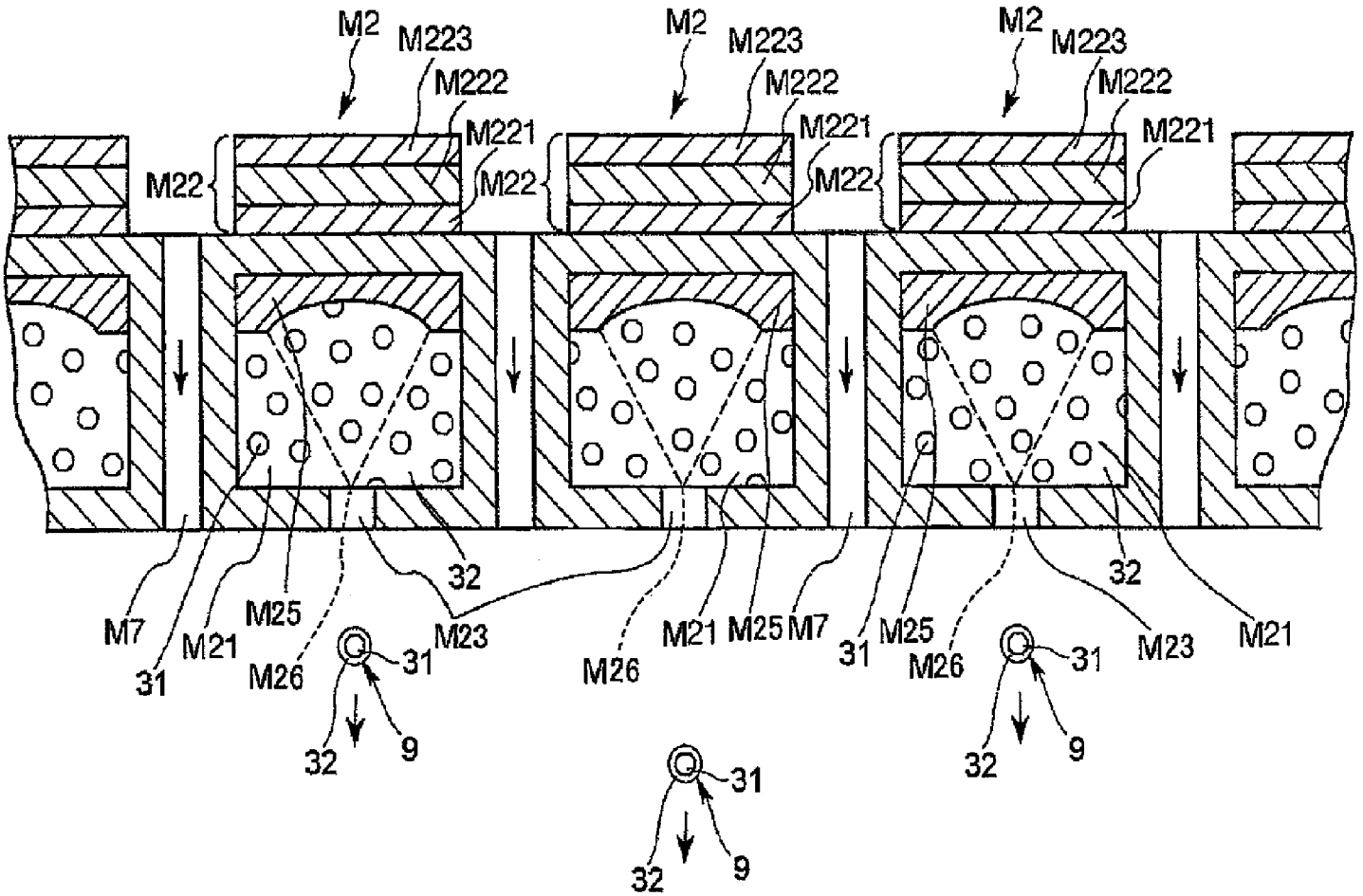
FIG. 4 is an illustration which schematically shows another example of the structure in the vicinity of the head portion of the toner matrix particle producing apparatus.

Moreover, as shown in FIG. 4, an acoustic lens (a concave lens) M25 may be provided in each head portion M2. By providing such an acoustic lens M25, it is possible to converge a pressure pulse (vibration energy) generated by a piezoelectric device M22 at a pressure pulse convergence portion M26 provided in the vicinity of each ejection portion M23. Therefore, vibration energy generated by the piezoelectric device M22 is efficiently used as energy for ejecting the water-based suspension 3. Consequently, even when the water-based suspension 3 stored in the dispersion liquid storage portion M21 has a relatively high viscosity, the water-based suspension 3 can be ejected from the ejection portion M23 reliably. Furthermore, even when the water-based suspension 3 stored in the dispersion liquid storage portion M21 has a relatively large cohesive force (surface tension), the water-based suspension 3 can be ejected in the form of fine droplets. As a result, it is possible to control the toner matrix particles (toner particles) 9 so as to have a relatively small particle size easily and reliably.

As described above, by the use of the head portion as shown in FIG. 4, it is possible to control the toner matrix particles 4 so that they have desired shape and size, even when a material having a relatively high viscosity or a material having a relatively large cohesive force is used as the water-based suspension 3. This extends the range of material choices, thereby enabling to produce toner particles having desired properties easily.

Further, by the use of the head portions as shown in FIG. 4, since the water-based suspension 3 is ejected using a convergent pressure pulse, the water-based suspension 3 in the form of droplets each having a relatively small size can be ejected, even in the case where the area (the area of an opening) of the ejecting portion M23 is relatively large. In other words, even in the case where it is desired that toner matrix particles 4 have a relatively small particle size, the area of the ejection portion M23 may be large. This makes it possible to prevent the occurrence of clogging in the ejection portion M23 more effectively even when the water-based suspension 3 has a relatively high viscosity.

In this regard, although in the head portions as shown in FIG. 4 a concave lens is used as the acoustic lens, the acoustic lens is not limited thereto. For example, a fresnel lens or an electronic scanning lens may also be used as an acoustic lens.

Figure 5:
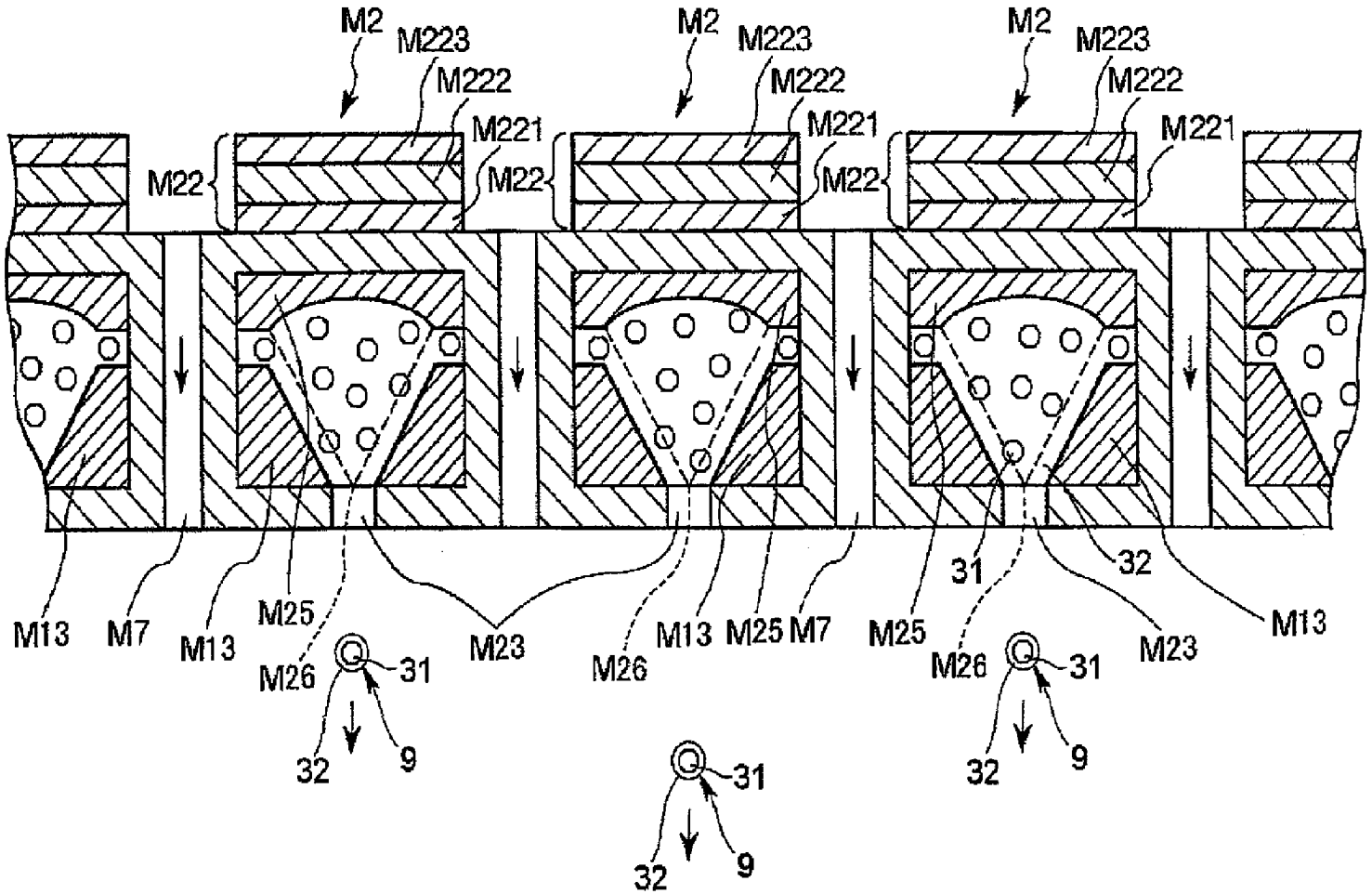
FIG. 5 is an illustration which schematically shows the other example of the structure in the vicinity of the head portion of the toner matrix particle producing apparatus.
Figure 6:
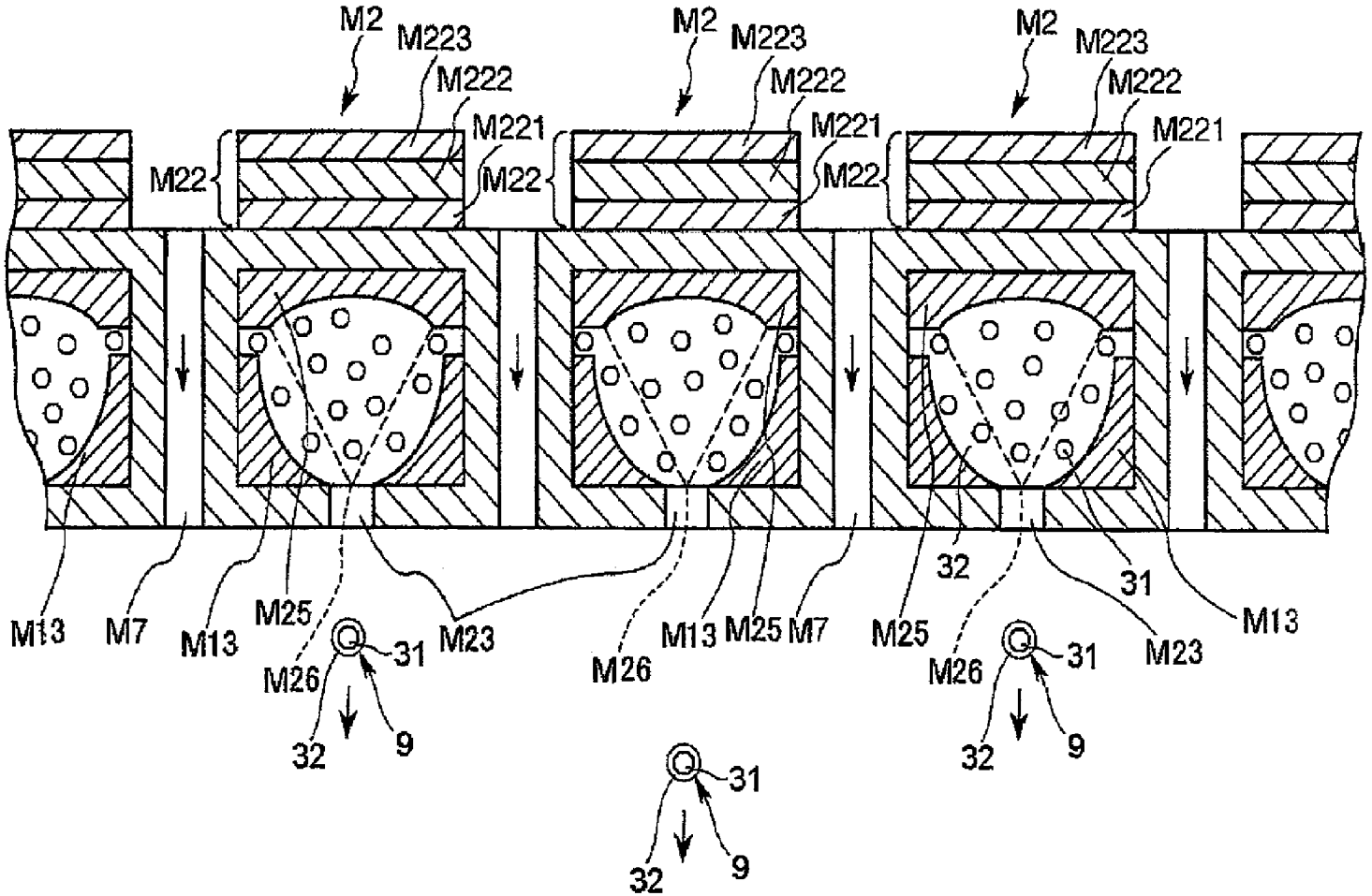
FIG. 6 is an illustration which schematically shows still other example of the structure in the vicinity of the head portion of the toner matrix particle producing apparatus.
Figure 7:
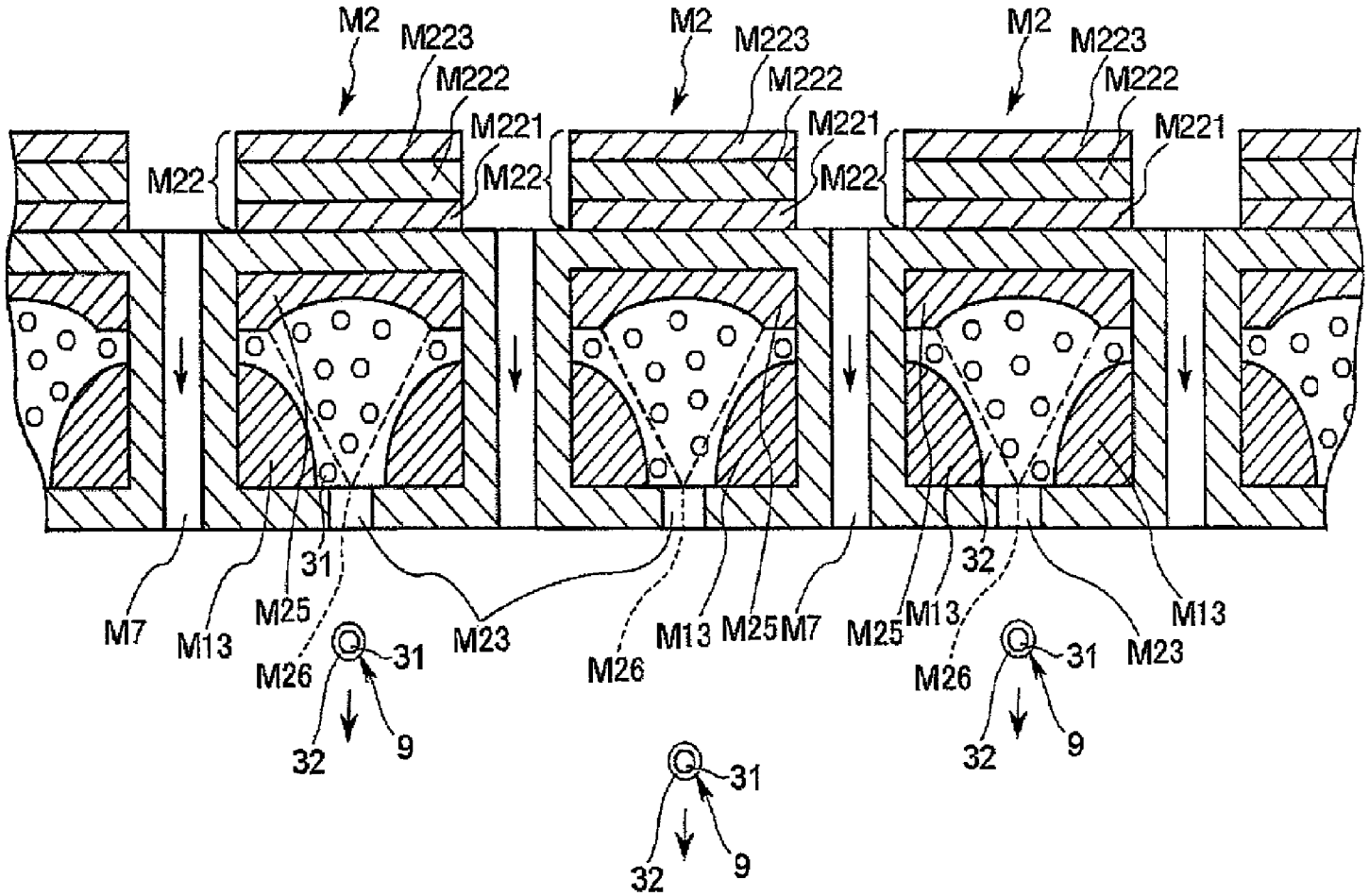
FIG. 7 is an illustration which schematically shows yet other example of the structure in the vicinity of the head portion of the toner matrix particle producing apparatus.

Further, head portions as shown in FIG. 5 to FIG. 7 can be used instead of the head portions of the toner matrix particle production apparatus in the above embodiment. In particular, a focusing member M13 having a shape convergent toward the ejection portion M23 may be provided between the acoustic lens M25 and the ejection portion M23, as shown in FIGS. 5 to 7. Such a focusing member helps the convergence of a pressure pulse (vibration energy) generated by the piezoelectric device M22, and therefore the pressure pulse generated by the piezoelectric device M22 is utilized more efficiently.

Furthermore, although in the embodiment described above the constituent material of the toner particles is contained in a dispersoid as a solid component thereof, but at least a part of the constituent material of the toner particles may be contained in the dispersion medium.

Further, although the embodiment described above has a structure in which the dispersion liquid (water-based suspension) is intermittently ejected from the head portions by the use of a piezoelectric pulse, the dispersion liquid may be ejected (discharged) by other methods. Examples of such other methods include a spray dry method, a so-called Bubble Jet method ("Bubble Jet" is a trademark) and a method disclosed in Japanese Patent Application No. 2002-321889, and the like. In the method disclosed in the Japanese Patent Application, a dispersion liquid is ejected in the form of droplets using a specific nozzle in which a dispersion liquid is transformed into a thin laminar flow by thinly expanding the dispersion liquid by forcing it onto a smooth flat surface using a gas flow, and then separating the thin laminar flow from the flat smooth surface to eject it in the form of droplets. The spray dry method is a method which obtains droplets by ejecting (spraying) a liquid (a dispersion liquid) using high pressure gas. Further, as an example of a method using the Bubble Jet method ("Bubble Jet" is a trademark), a method disclosed in Japanese Patent Application No. 2002-169348 and the like can be mentioned. Namely, the dispersion liquid may be ejected (discharged) by a method in which a dispersion liquid is intermittently ejected from a head portion using a volume change of gas.

Moreover, formation of the toner matrix particles may be carried out without using the ejection of the dispersion liquid (water-based suspension). For example, it is possible to obtain toner matrix particles by filtering the water-based suspension to filter out fine particles corresponding to a dispersoid.

Moreover, in the above embodiment, toner matrix particles each having shape and size corresponding to each particle of the dispersoid contained in the water-based suspension is obtained. However, the toner matrix particles of the present invention may be formed from aggregates which are formed by aggregating (or bonding) a plurality of particles of a dispersoid contained in the water-based suspension.

Moreover, in the above embodiment, a water-based emulsion is prepared using ground particles obtained by grinding the kneaded material, but such a grinding step of the kneaded material may be omitted.

Moreover, a method for preparing the water-based emulsion and the water-based suspension is not limited to the method described above. For example, it is possible to obtain a water-based emulsion by heating a dispersion liquid in which a solid state dispersoid is dispersed to transform the dispersoid into a liquid state, and then by cooling the water-based emulsion to obtain the water-based suspension.

Moreover, in the embodiment described above, once after a water-based suspension is obtained using a water-based emulsion, toner matrix particles are produced using the water-based suspension. However, the toner matrix particles may be produced directly from the water-based emulsion without using the water-based suspension. For example, it is possible to obtain toner matrix particles by ejecting the water-based emulsion in the form of droplets, and then removing the dispersion medium together with the solvent contained in the dispersoid from the droplets.

Moreover, in the embodiment described above, a part of the polymeric dispersant remains in the insulation liquid without adhering to the surfaces of the toner matrix particle. In such a case, aggregation of the toner particles can be effectively prevented.

EXAMPLES

(1) Production of Liquid Developer

Example 1

First, 80 parts by weight of a polyester resin having —$SO_3^-$ groups (sulfonic acid Na group) as side chains (softening point thereof was 124° C.) was prepared as a binder resin, and 20 parts by weight of a cyanine pigment ("Pigment Blue 15:3", manufactured by Dainichiseika Color & Chemicals Mfg. Co., Ltd.) was prepared as a coloring agent.

These components were mixed using a 20 L type Henschel mixer to obtain a material for producing toner particles.

Next, the material (mixture) was kneaded using a biaxial kneader-extruder shown in FIG. 1. The entire length of a process section of the biaxial kneader-extruder was 160 cm. Further, the material temperature in the process section was set to be 105 to 115° C. Furthermore, the rotational speed of the screws was set to be 120 rpm, and the speed for feeding the material into the kneader-extruder was set to be 20 kg/hour.

Under these conditions, a time required for the material to pass through the process section was about four minutes.

The kneading was carried out with deairing the inside of the process section by driving a vacuum pump connected to the process section through a deairing port.

The material (kneaded material) kneaded in the process section was extruded outside the biaxial kneader-extruder from the head portion. The temperature of the kneaded material at the head portion was adjusted to be 130° C.

The kneaded material extruded from the extruding port of the biaxial kneader-extruder was cooled by a cooling machine as shown in FIG. 1. The temperature of the kneaded material just after the cooling process was about 45° C.

The cooling rate of the kneaded material was 9° C./sec. Further, the time required for the completion of the cooling process after the end of the kneading process was 10 seconds.

The, the kneaded material cooled as described above was coarsely ground using a hammer mil to be formed into powder having an average particle size of 1.5 mm.

Next, 250 parts by weight of toluene was added to 100 parts by weight of the coarsely ground kneaded material, and then it was subjected to a treatment using an ultrasound homogenizer (output: 400 μA) for one hour to obtain a solution in which the polyester resin of the kneaded material was dissolved. In the solution, the pigment was finely dispersed homogeneously.

Further, 1 part by weight of sodium-dodecylbenzenesulfonic acid as a surfactant was homogeneously mixed with 700 parts by weight of ion-exchanged water to obtain a water-based liquid.

The water-based liquid was stirred with a homomixer (PRIMIX Corporation) with the number of stirring being adjusted.

The above-mentioned solution (that is, the toluene solution of the kneaded material) was dropped in the water-based liquid which is being stirred, to obtain a water-based emulsion in which a dispersoid comprised of particles having an average particle size of 3 μm was homogeneously dispersed.

Thereafter, the toluene in the water-based emulsion was removed under the conditions in which a temperature was 100° C. and an ambience pressure was 80 kPa, and then it was cooled to room temperature. Then, a predetermined amount of water was added thereto so that the concentration was adjusted to thereby obtain a water-based suspension in which solid fine particles were dispersed. In the thus obtained water-based suspension, substantially no toluene remains. The concentration of the solid component (dispersoid) of the thus obtained water-based suspension was 28.8 wt %. Further, the average particle size of the particles of the dispersoid (solid fine particles) dispersed in the suspension was 1.2 μm. The measurement of the average particle size was carried out using a laser diffraction/scattering type particle size distribution measurement apparatus ("LA-920" which is a product name of HORIBA Ltd.).

The thus obtained suspension was put into a water-based suspension supply section of a toner matrix particle production apparatus shown in FIGS. 2 and 3. The water-based suspension in the water-based suspension supply section was being stirred with a stirring means, and it was supplied to head portions by a metering pump so the suspension was ejected (discharged) to a dispersion medium removal section through ejection portions of the head portions. Each ejection portion was a circular opening having a diameter of 25 μm. The head portions were of the type that a hydrophobic treatment was made around the ejection portions thereof with a fluorine resin (polytetrafluoroethylene) coating. Further, the temperature of the water-based suspension in the water-based suspension supply section was adjusted to be 25° C.

The ejection of the water-based suspension was carried out under the conditions That the temperature of the dispersion liquid in the head portions was 25° C., the frequency of vibration of each piezoelectric element was 10 kHz, the initial velocity of the dispersion liquid ejected from the ejection portions was 3 m/sec, and the size of one droplet ejected from each head portion was 4 pl (the diameter thereof was 20.8 μm). Further, the ejection of the water-based suspension was carried out so that the ejection timing of the water-based suspension was changed at least in the adjacent head portions in the plural head portions.

Further, when the water-based suspension was ejected, air was also ejected from the gas injection openings downwardly in a vertical direction, wherein the temperature of the air was 25° C., the humidity of the air was 27% RH, and the flow rate of the air was 3 m/sec. Further, the temperature of the inside of the housing (that is, the ambient temperature) was set to be 45° C., the pressure of the inside of the housing was about 1.5 kPa, and the length of the dispersion medium removal section (in the direction of conveying the dispersoid) was 1.0 m.

Furthermore, a voltage was applied to a part of the housing which constitutes the dispersion medium removal section so that an electrical potential at the side of the inner surface thereof was −200 V, thereby preventing the water-based suspension (toner matrix particles) from adhering to the inner surface of the housing.

Then, the dispersion medium was removed from the ejected water-based suspension in the dispersion medium removal section to thereby obtain toner matrix particles each having shape and size corresponding to each particle of the dispersoid.

Thereafter, the toner matrix particles formed in the dispersion medium removal section were collected at the cyclone.

<Dispersion of Toner Matrix Particles and Polymeric Dispersant>

505 parts by weight of a soybean oil ("Soybean Oil", a product of Kanto Chemical Co., Inc.) as an insulation liquid, 1 parts by weight of a condensation copolymer of a polyamine compound and a hydroxy aliphatic compound ("SOLSPERSE 11200", a product name of Lubrizol Japan Ltd., density thereof was 0.79 g/cm$^3$) as a polymeric dispersant, and 75 parts by weight of the above-mentioned toner matrix particles were mixed with being stirred by a homomixer (PRIMIX Corporation) for five minutes, to thereby obtain a liquid developer. The electrical resistance of the soybean at room temperature (20° C.) was $1.4\times10^{14}$ Ωcm, and the viscosity thereof at room temperature (20° C.) was 56 mPa·s.

Example 2

A liquid developer was prepared in the same manner as in the Example 1 excepting that a cyan-based pigment derivative ("SOLSPERSE 22000", a product name of Lubrizol Japan Ltd.) was used as the coloring agent, and a condensation copolymer of a polyamine compound and a hydroxy aliphatic compound ("SOLSPERSE 13940", a product name of Lubrizol Japan Ltd.) was used as the polymeric dispersant.

Example 3

A liquid developer was prepared in the same manner as in the Example 1 excepting that a liquid paraffin having a viscosity of 171 mPa·s at a temperature 20° C. (Wako Pure Chemical Industies, Ltd.) was used as the insulation liquid.

Example 4

A liquid developer was prepared in the same manner as in the Example 2 excepting that a liquid paraffin having a viscosity of 171 mPa·s at a temperature 20° C. (Wako Pure Chemical Industies, Ltd.) was used as the insulation liquid.

Example 5

A liquid developer was prepared in the same manner as in the Example 1 excepting that a polyester resin having no $—SO_3^-$ group (sulfonic acid Na group) was used.

Comparative Example

A liquid developer was prepared in the same manner as in the Example 5 excepting that no polymeric dispersant was used.

The conditions for producing the liquid developers of the Examples and the Comparative Example are shown in the following Table 1.

TABLE 1

| | | Polymeric dispersant | | | | Insulation liquid | |
|---|---|---|---|---|---|---|---|
| | Polyester resin $—SO_3^-$ | Kind | Density [g/cm$^3$] | Amine group (No or Yes) | Ester structure (No or Yes) | Kind | Electric resistance [Ωcm] |
| EX. 1 | Yes | SOLSPERSE 11200 | 0.79 | Yes | Yes | Soybean oil | $1.4 \times 10^{14}$ |
| EX. 2 | Yes | SOLSPERSE 13940 | 0.82 | Yes | Yes | Soybean oil | $1.2 \times 10^{14}$ |
| EX. 3 | Yes | SOLSPERSE 11200 | 0.79 | Yes | Yes | Liquid paraffin | $6.2 \times 10^{14}$ |
| EX. 4 | Yes | SOLSPERSE 13940 | 0.82 | Yes | Yes | Liquid paraffin | $5.8 \times 10^{14}$ |
| EX. 5 | No | SOLSPERSE 11200 | 0.79 | Yes | Yes | Soybean oil | $2.1 \times 10^{14}$ |
| Com. Ex. | No | — | — | — | — | Soybean oil | $2.3 \times 10^{14}$ |

(2) Evaluation

For the respective liquid developers obtained as described above, dispersing stability, fixing characteristics (fixing strength), preservability (storage stability), and chargeable characteristics were evaluated.

(2.1) Dispersing Stability 10 mL of each of the liquid developers obtained in the Examples 1 to 5 and the Comparative Example 1 was put into a centrifuging tube and centrifugalised under the condition of 1000 G for 10 minutes. Then, 200 μL of supernatant liquid thereof was collected and then diluted by 100 times with a carrier solvent ("ISOPER H") using as a sample.

Next, for each of the samples, an absorption wavelength was measured using a visible-ultraviolet spectrophotometer ("V-570", manufactured by JASCO Corporation). The measurement results were evaluated according to the following four criteria based on absorbance of an absorption range (685 nm) of a cyanogen-based pigment.

A: Absorbance was 1.50 or higher (settling of toner particles was not observed at all).

B: Absorbance was 1.00 or higher but lower than 1.50 (settling of toner particles was scarcely observed).

C: Absorbance was 0.50 or higher but lower than 1.00 (settling of toner particles was observed).

D: Absorbance was lower than 0.50 (settling of toner particles were clearly observed and the settling begins even in a state of being left under natural conditions).

(2.2) Fixing Characteristics (Fixing Strength)

By using the image forming apparatus described in JP-A 2002-214849 which is mentioned as a prior art, images having a predetermined pattern were formed on recording papers (High quality paper "LPCPPA4" produced by Seiko Epson Corporation) employing the liquid developers of the Examples 1 to 5 and the Comparative Example 1, respectively. Then, the images formed on the papers were thermally fixed onto the papers using an oven. The thermal fixing was carried out under the conditions of 120° C. for 30 minutes.

Thereafter, after it was confirmed as to whether or not a non-offset area was present, the fixed image on each of the papers was rubbed out twice using a sand eraser ("LION 261-11", a product of LION OFFICE PRODUCTS CORP.) with a pressure loading of 1.0 kgf/cm$^2$. Then, the residual rate of the image density of each recording paper was measured by a calorimeter "X-Rite model 404" (X-Rite Incorporated), and the measurement results were evaluated according to the following four criteria.

A: Residual rate of the image density was 90% or higher

B: Residual rate of the image density was 80% or higher but lower than 90%

C: Residual rate of the image density was 70% or higher but lower than 80%

D: Residual rate of the image density was lower than 70%

(2.3) Preservability (Storage Stability)

The liquid developers obtained in the Examples 1 to 5 and the Comparative Example 1 were being placed under the atmosphere in which temperature was in the range of 15 to 20° C. for six months. Thereafter, conditions of the toner particles in the liquid developers were visually observed, and the observation results were evaluated by the following four criteria.

A: Aggregation and settling of toner particles were not observed at all.

B: Aggregation and settling of toner particles were scarcely observed.

C: Aggregation and settling of toner particles were slightly observed.

D: Aggregation and settling of toner particles were clearly observed.

(2.4) Chargeable Characteristics (Electrification Properties)

By using a laser zeta electrometer "ELS-6000" (manufactured by OTSUKA ELECTRONICS CO., LTD.), chargeable characteristics (electrification properties) of the liquid developers obtained in the Example 1 to 5 and the Comparative Example 1 were evaluated by the following four criteria.

A: Electric potential difference was +50 mV or larger.

B: Electric potential difference was +45 mV or larger but smaller than +50 mV.

C: Electric potential difference was +30 mV or larger but smaller than +45 mV.

D: Electric potential difference was smaller than +30 mV.

These results are shown in the following Table 2 together with the average particle size of the toner particles as per volume of the toner matrix particles, the standard deviation in the particle size of the toner particles, the average roundness R, and the standard deviation in the roundness.

TABLE 2

| | Toner matrix particles | | | | Evaluation | | | |
|---|---|---|---|---|---|---|---|---|
| | Average particle size [μm] | Standard deviation of particle size [μm] | Average roundness R | Deviation of roundness | Dispersion stability | Fixing strength | Storage stability | Electrification property |
| EX. 1 | 1.4 | 0.21 | 0.97 | 0.01 | A | A | A | A |
| EX. 2 | 1.8 | 0.42 | 0.92 | 0.02 | A | A | A | A |
| EX. 3 | 1.3 | 0.31 | 0.95 | 0.02 | B | A | B | B |
| EX. 4 | 1.5 | 0.23 | 0.93 | 0.03 | B | A | B | B |
| EX. 5 | 2.1 | 0.34 | 0.95 | 0.02 | A | A | B | B |
| Com. Ex. | 3.2 | 1.10 | 0.80 | 0.12 | D | C | D | D |

As shown in Table 2, the liquid developers according to the present invention (that is, the liquid developers of the Examples 1 to 5) were superior in the dispersing stability, fixing characteristics, preservability (storage stability), and chargeable characteristics. In contrast, in the liquid developer of the Comparative Example, satisfactory results could not be obtained.

On the other hand, when the liquid developer of the Comparative Example was used, it was not possible to form an image. It is supposed that this result was caused because the toner particles in the liquid developer had not been sufficiently positively-charged.

Furthermore, liquid developers which are the same as those described above were produced excepting that as a coloring agent a pigment red 122, a pigment yellow 180, and a carbon black ("Printex L" Degussa AG) were used instead of the cyanogen-based pigment, and they were evaluated in the same manner as described above. As a result, substantially the same results could be obtained.

Moreover, liquid developers which are the same as those described above were produced using a different toner matrix particle production apparatus in which the structure of the head portions was changed from the structure shown in FIG. 3 to the structure shown in each of FIGS. 4 to 7. As a result, substantially the same results could be obtained. Further, the toner matrix particle production apparatuses shown in FIGS. 4 to 7 could appropriately eject a water-based suspension having relatively high concentration (dispersion liquid having high content of dispersoid) even if the diameter of the ejection portion was made small. Furthermore, because such a high concentration of water-based suspension was used, the time required for drying the water-based suspension could be reduced, whereby the productivity of toner particles (liquid developer) was improved.

Finally, it is to be noted that the present invention is not limited to the embodiments and the examples described above, and many additions and modifications may be made without departing from the spirit of the present invention which is defined by the following claims.

What is claimed is:

1. A positively-charged liquid developer, comprising:

an insulation liquid; and toner particles dispersed in the insulation liquid, wherein each of the toner particles comprises a toner matrix particle mainly constituted of a polyester resin being of the type that a $—SO_3^-$ group is contained in its molecule and a positively-charged polymeric dispersant adhering to the surface of the toner matrix particle.

2. The liquid developer as claimed in claim 1, wherein the polymeric dispersant is of the type that an amino group is contained in its molecule.

3. The liquid developer as claimed in claim 1, wherein the polymeric dispersant is of the type that an ester structure is contained in its molecule.

4. The liquid developer as claimed in claim 1, wherein the amount of the polymeric dispersant adhering to the surfaces of the toner matrix particles is in the range of 1 to 20 parts by weight with respect to 100 parts by weight of the polyester resin.

5. The liquid developer as claimed in claim 1, wherein the density of the polymeric dispersant is in the range of 0.8 to 1.0 $g/cm^3$.

6. The liquid developer as claimed in claim 1, wherein the number of moles of the $—SO_3^-$ group contained in the polyester resin is in the range of 0.001 to 0.050 mol with respect to 100 g of the polyester resin.

7. The liquid developer as claimed in claim 1, wherein the acid value of the polyester resin is in the range of 5 to 20 KOHmg/g.

8. The liquid developer as claimed in claim 1, wherein the insulation liquid contains at least one of linseed oil and soybean oil as its main component.

9. A positively-charged liquid developer, comprising:

an insulation liquid; and toner particles dispersed in the insulation liquid, wherein each of the toner particles comprises a toner matrix particle mainly constituted of a polyester resin being of the type that a $—SO_3^-$ group is contained in its molecule and a positively-charged polymeric dispersant adhering to the surface of the toner matrix particle, and wherein the amount of the polymeric dispersant adhering to the surfaces of the toner matrix particles is in the range of 1 to 20 parts by weight with respect to 100 parts by weight of the polyester resin and the number of moles of the $—SO_3^-$ group contained in the polyester resin is in the range of 0.001 to 0.050 mol with respect to 100 g of the polyester resin.

* * * * *